US006106033A

United States Patent [19]

Rückert

[11] Patent Number: 6,106,033

[45] Date of Patent: Aug. 22, 2000

[54] CATCH-HOOK ARRANGEMENT FOR A FRONT HOOD OR THE LIKE ON MOTOR VEHICLES

[75] Inventor: Edvard Rückert, Velbert, Germany

[73] Assignee: Ewald Witte GmbH & Co. KG, Velbert, Germany

[21] Appl. No.: 09/025,298

[22] Filed: Feb. 18, 1998

[30] Foreign Application Priority Data

Aug. 26, 1997 [DE] Germany ..... 197 37 096
Feb. 4, 1998 [DE] Germany ..... 198 04 066

[51] Int. Cl.[7] ..... E05C 3/06

[52] U.S. Cl. ..... 292/216; 292/DIG. 14

[58] Field of Search ..... 292/216, DIG. 14, 292/DIG. 43, 25–30, 45–50, 52, 53, 99, 198, 225, 226

[56] References Cited

U.S. PATENT DOCUMENTS

| | | | |
|---|---|---|---|
| 2,253,660 | 8/1941 | Tell | 292/128 |
| 2,777,721 | 1/1957 | Burke et al. | 292/216 |
| 2,881,021 | 7/1959 | Jacobson | 292/229 |
| 2,924,473 | 2/1960 | Krause | 292/DIG. 14 |
| 3,236,551 | 2/1966 | Nash | 292/216 |
| 3,239,260 | 3/1966 | Beckman et al. | 292/216 |
| 3,572,793 | 3/1971 | Cole | 292/216 |
| 3,599,743 | 8/1971 | Hull | 292/216 |
| 3,904,624 | 9/1975 | Fujita | 292/216 |
| 4,691,949 | 9/1987 | Grantz et al. | 292/216 |
| 5,048,877 | 9/1991 | Rogers, Jr. et al. | 292/216 |
| 5,348,355 | 9/1994 | Oyha | 292/216 |
| 5,738,393 | 4/1998 | Chao | 292/216 |
| 5,853,060 | 12/1998 | Chao et al. | 292/216 |

*Primary Examiner*—B. Dayoan
*Assistant Examiner*—Clifford B Vaterlaus
*Attorney, Agent, or Firm*—Martin A. Farber

[57] ABSTRACT

A catch hook device for a front hood, or the like, on motor vehicles has a closure hoop and a catch hook, which can be fastened alternatively on the front end of the body of the car or on the front hood. The device holds the front hood in a slit-open position after the opening of the closure by mutual hook engagement. The hook engagement is detachable and can be obtained automatically upon the closing of the hood. In order to optimize the dependability of the closure and to prevent deformations, larger tolerance, etc. from leading to an unintended release of the hook engagement, the catch hook (F, F', F", F"', F"", F"") has a first hook part (8, 38, 65, 84, 105, 128) between the end sections of its two legs (11, 12; 42, 43; 66, 67; 85, 86; 106, 107; 129, 130) for the passage of the closure hoop (4, 33, 60, 83, 104, 132) on the one leg end section of which there is pivoted a second hook part (15, 45, 71, 96, 114, 143) which is developed as a closure part and which closes the opening (7, 41, 70, 87, 108, 131) in a force-locked manner.

31 Claims, 21 Drawing Sheets

CATCH-HOOK ARRANGEMENT FOR A FRONT HOOD OR THE LIKE ON MOTOR VEHICLES

FIELD AND BACKGROUND OF THE INVENTION

The present invention relates to a catch-hook arrangement for a front hood or the like on motor vehicles, which has a closure hoop and a catch hook which can be fastened alternately on the front end of the body or on the front hood and which holds the front hood in a slit opening after the opening of a closure by mutual hook engagement, the hook engagement being disengageable and being obtainable automatically upon the closing of the front hood.

Catch-hook arrangements of the aforementioned type are known on passenger cars at present on the market, in which, after the release of the closure, the front hood is held in the slit-open position by the catch hook. The complete opening of the front hood then requires the swinging of the front catch hook into the release position with respect to the closure hoop. In actual practice, it has been found that upon deformations in the front region of the motor vehicle, which in many cases is not obvious, an insufficiently secured hook engagement is present. If the vehicle is moved in this condition, this can result in an undesired opening of the front hood with the disadvantages resulting therefrom.

SUMMARY OF THE INVENTION

The object of the invention is to provide a catch-hook arrangement of the type in question which is of optimal dependability of closure in such a way that even deformations, larger tolerances, etc. do not lead to an undesired release of the hook engagement.

This technical problem is first of all solved centrally in a catch-hook arrangement of the introductorily-mentioned type in which the catch hook has a first hook part provided, between the end section of its two legs, with an opening for the passage of the closure hoop, on the one leg end section of which a second hook part developed as closure part is pivoted, it closing the opening when acted on by force.

In accordance with the invention, a catch-hook arrangement of extremely high reliability is indicated. It operates essentially in accordance with the snap-hook principle. After the slit-open position of the front hood has been produced, the opening can be effected only intentionally. The opening of the closure hoop is namely effected in this position by the second part of the hook which is developed as closure part. Said hook part rests on the one leg end section and is acted on by force in the direction of its closed position. Upon the closing of the open front hood, the closure part is acted on by the closure hoop and swings positively against the action of force out of its closed position. As soon as the closure hoop rests within the catch hook, the closure part is released to swing into its closed position. In detail, this means that, after release of the closure associated with the front hood, the front hood enters into the slit-open position. Thereupon, for the complete opening of the front hood, the closure part must be brought of engagement, since otherwise the closure hoop cannot pass by the opening of the first hook part. In this way, there is obtained the great advantage in security that, even upon deformations of the passenger car, in the front region, the closure hoop lies is a hook part which is closed all around and thus prevents the unintended opening of the front hood. In one version, the first hook part is developed in U-shape. Its opening faces in a direction of the closure hoop, the closure part closing the opening when the front hood is closed. After release of the closure, the second hook part—closure part—must then be brought into a position which releases the opening so as to permit the swinging open then of the front hood. If no displacement of the closure part into the position releasing the opening takes place and it is attempted to open the front hood, then the closure hoop acts on the closure part in the direction of its form-locked engagement. In this case, the closure hoop presses against the support shoulder developed by the closure part. For the complete opening of the front hood therefore, the supporting shoulder must be brought out of the region of movement of the closure hoop. In advantageous manner, the form-locked engagement is developed by a hooking. This acts in the manner that a projection pointing away from the U-opening enters into a recess of the end section of the second hook part. The latter leads to a stable closed position of the catch-hook arrangement. Then it is provided as alternative that the first hook part has a fastening means in the region of the U-vertex. This permits a fixing which can be swung with respect to a spring around a spring-loaded central position. For example, the fixing can be obtained by projections or springs which act on the U-legs on both sides. The opening of the front hood out of the slit-open position is possibly by the release which is pivoted to the first hook part. This release is accessible from the outside of the vehicle. In detail, this means that the release, by swinging, shifts the second hook part into the open position. For this, the release is coupled with the second hook part via a pin/cam control. The latter is of such a nature that, in the closed position of the front hood, while swinging of the release can be effected, this however does not act on a swinging of the closure part. The latter therefore remains in form-locked engagement with the first hook part. In detail, the release is developed as an angle-leg lever with a hook extension extending into the region of movement of the closure hoop. This extension is acted on by the closure hoop by the closing of the front hood and therefore forces the swinging of the hoop which transfers the second hook part into the form-locked engagement. In order to bring about the open position of the front hood, the release has on the leg end a point of attack for a handle. The latter is in concealed position within the region of the hood, but in a position in the region of the hood which is nevertheless readily accessible. In order that the second hook part can be brought completely into the release position in the slit-open position of the front hood via the release, a distance is provided between the closure hoop leg and the second hook part is provided in the slit position of the front hood, this distance permitting a swinging of the second hook part into the position of release for the closure hoop. If the front hood assumes its open position and if it is closed, then in the final phase of the closing of the closure-hoop arm, the closure part on the opening upwardly directed control bevel. When the closure hoop is engaged, its arm lies opposite an opening inwardly directed support shoulder which extends parallel to the opening, which shoulder is acted on when the closure part is not released and moves it into the direction of a form-locked engagement.

An alternative solution is characterized by the fact that the U-shaped hook part is formed by a carrier plate which carries the closure which cooperates with the closure hoop. Catch-hook arrangement and closure are now associated with a common carrier plate which considerably simplifies installation and furthermore results in advantages with regard to the saving of manufacturing expenses. One and the same closure hoop acts together both with the closure and with the catch-hook arrangement. In the closure position of the front hood, the closure hoop cannot unintentionally move out of its engaged position as a result of the fact that the closure part reliably closes the U-opening of the U-shaped hook part. The opening of the front hood requires, first of all, the release of the closure hoop by the closure associated with the carrier plate. Thereupon, the closure part is to be shifted into the release position, which then permits the swinging open of the front hood. The carrier plate with hook arrangement and closure can be fastened either on the car body or on the front hood. This applies also to the closure hoop. A reliable closed position of the closure part in the closed position of the front hood is assured by a control lever pivoted in particular on the U-leg of the carrier plate which serves to transfer the second closure part in the direction of the form-locked engagement upon entrance of the closure hoop into the closure. Therefore, in all cases, the closure part is brought into the form-locked engagement position with respect to the catch hook when the front hood is closed. Accordingly, the control lever acts in a certain way like the release lever, aside from the fact that it is not used for the release. In advantageous fashion, the control lever is developed as a double-armed lever and can be acted on, on its first lever arm, by the closure hoop. By its second closure arm, the control lever acts against a driver of the closure part. The further the closure hoop moves into its engagement position, the further the closure part is swung into the form-locked engagement direction via the control lever. In order to eliminate the catch-hook engagement, the closure part forms a handle. If upon release of the closure, the front hood assumes a slit-open position, then the handle can be brought into a position which releases the U opening. The interaction of the catch-hook arrangement with the closure is optimal when it is developed as rotary trap closure.

Another possibility is to link the closure part to a hook-shaped extension of the first hook part. Here, again, the closure hoop is completely surrounded within the first hook part when the front hood is closed. The opening of the front hood after the release of the closure in this case also requires that the closure part is brought out of its position in which it closes the opening of the first hook part. In accordance with this version, the carrier shoulder is not formed by the closure part but by the release which acts on the closure part. If the closure associated with the front hood is brought into the position of release, the release-side carrier shoulder is then to be shifted. This is done by additional action on the release, so that, in this connection, the extension of the first hook part also comes out of the path of movement of the closure hoop. The action on the release is made possible in the manner that the closure hoop, upon its displacement from the closed position of the hood into the slit-open position by the action of an edge of the release so swings the latter that a handle can be actuated. Until the slit-open position of the hood has been reached therefore, only a first swinging of the release takes place. This position of swing in this connection brings a handle into the region of grasp of the hand of a person swinging the front hood, so that the release can thereby be carried along completely and thereby bring the two hook parts into the release position.

Another alternative is characterized by the fact that the second hook part and the release are so coupled with each other and/or mounted that forces of inertia acting on them lead to a self-blocking of the second hook part and release which is held by an end of a first leg of the catch-hook arrangement in a closed position. For the blocking, the closure hoop therefore is not necessary. Rather, for instance, in the case of a front head-on collision and the forces of inertia acting in this connection on the hook part and release, both the release and the second hook part are brought into a blocking position which prevents the emergence of the closure hoop. In detail, this means that such a supporting or dimensioning of the return spring of the second hook part and/or release is present that the second hook part acts beforehand upon the release in the case of a sudden jolt action of inertia forces. The mass of the release and of the second hook part, as well as the forces of the springs acting on them are adapted to each other. In actual use, this means that the spring force acting on the second hook part is less than that acting on the release, so that, as a result of the advance action of the second hook part the blocking of the release takes place. There is then an alternative which consists in providing a blocking shoulder developed by the cam curve of the pin/cam control, against which the pin strikes upon sudden action of inertia forces. Here also, the condition is obtained that the second hook part comes into a blocking position with respect to the release and thus prevents the release of the closure hoop. The hood of the motor vehicle remains thereby secured. The release must be intentionally effected, in which case, by displacement of the release, the pin passes over the cam curve in accordance with what is intended in order thereby to bring the second hook part out of engagement with the first hook part. Further security is obtained in simple manner in this version thereby that the self-blocking occurs upon a strongly accelerated swinging of the release. Accordingly, opening of the closure does not take place even when the release serves for any reason displaced too rapidly into its position of release. For this there is served a pin-acceleration curve arranged in front of the blocking shoulder opposite which a section of the cam curve having the blocking shoulder. The pin-acceleration curve can be developed in the manner of a snap ring so that upon the strongly accelerated release swinging, the pin is articulated, as a result of the snap ring on the blocking shoulder, together with a blocking of the second hook part and release. Finally, a variant in accordance with the invention also consists therein that the closure part is developed as double-armed lever, the one lever arm of which closes the hook opening off against emergence of the closure hoop and the other lever arm is acted on against the opening actuation. The closure hoop can therefore leave the hook opening only when the double-armed lever has previously been intentionally brought into its position of release. If this is not the case, then the closure hoop produces only a displacement of the double-armed lever into its position closing the hook opening. The hoop arm is brought out of engagement by a cam of an actuating lever. The lever is so placed that the actuating lever swings transverse to the direction of swing of the closure part.

BRIEF DESCRIPTION OF THE DRAWINGS

With the above and other objects and other advantages in view, the present invention will become more clearly understood in connection with the detailed description of preferred embodiments, when considered with the accompanying drawings of which.

DETAILED DESCRIPTION OF THE PREFERRED EMBODIMENTS

Figure 2:
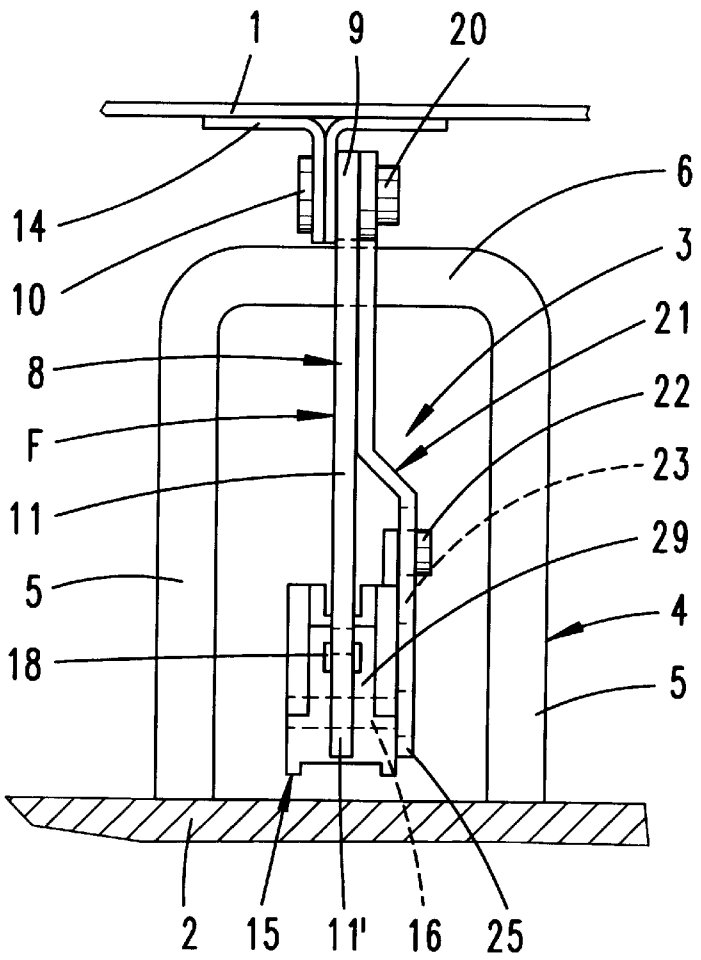
FIG. 2 shows the 90° swung position of FIG. 1.
Figure 1:
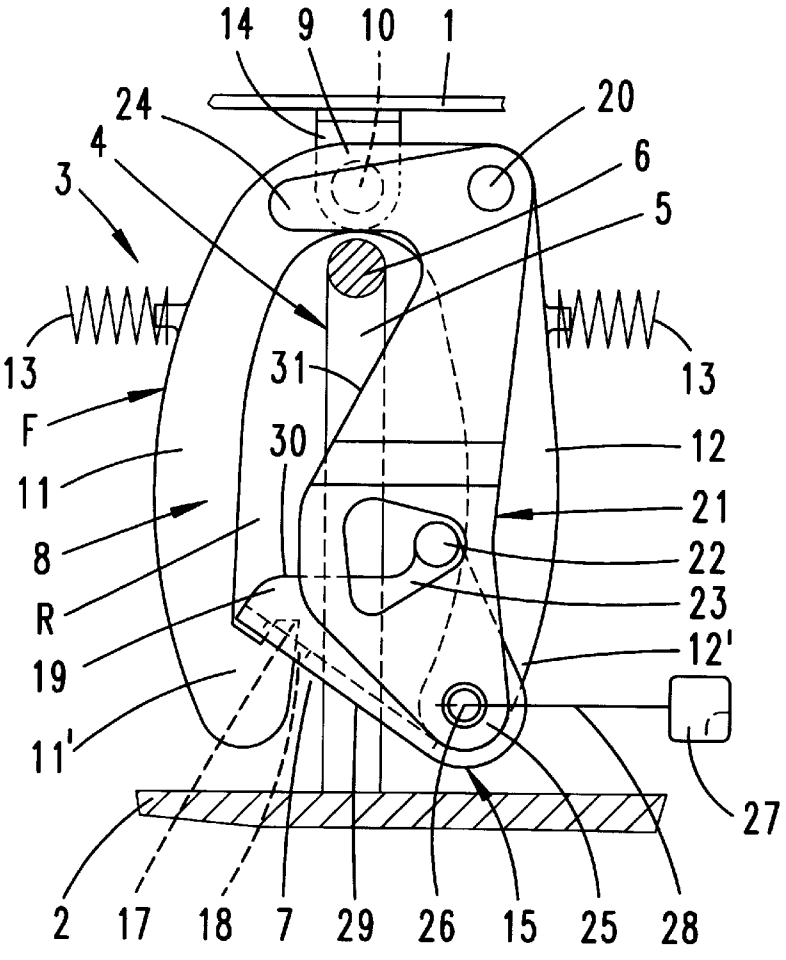
FIG. 1 is a section through a catch-hook arrangement of a passenger car, shown in the locked position of the front hood, in the case of the first embodiment.

In accordance with the first embodiment shown in FIGS. 1 to 5, a front hood 1 is shown diagrammatically in FIGS. 1 and 2. The front hood in its closed position in a given place with respect to the car body shown diagrammatically, by means of a known closure, not shown.

The front hood is provided with a catch-hook arrangement designated generally as 3. A part thereof is a U-shaped closure hoop 4 extending from of the front end of the car body 2. Its U-legs 5 are fixed at the end on the body of the car 2, while the U-leg 6 extends horizontally. It cooperates with a closure hook F which has a first U-shaped hook part 8 leaving an opening 7 facing the closure hoop 4. The hook part 8 is held in the region 9 of the U-vertex by a pin-like fastening means 10, namely in a spring-actuated middle position for which schematically shown compression springs 13 act on the U-legs 11, 12. However, any other positioning of the hook part 8 in the middle position could also be present. For example, a swingable arrangement of the hook part 8 could also be dispensed with. The fastening means 10 is taken up by a bearing block 14 fastened on the front hood 1.

On the one U-leg end section 12' there is pivoted a second hook part 15 developed as closure part. The corresponding point of articulation is designated by the numeral 16. A torsion spring (not shown) acts on the second hook part 15 in counterclockwise direction in such a manner that it swings into the U-shaped intermediate space R and in this connection comes into a form-locked engagement with the other U-leg section 11'. This section is formed by a hooking. For this purpose, the U-leg end section 11' forms a projection 17 pointing away from the hook opening 7 and which extends into a recess 18 in the end section 19 of the second hook part 15.

On the first hook part 8, laterally adjacent to the fastening means 10, a release 21 is articulated around a bearing pin 20. If the release is swung, it moves over the second hook part 15, starting from the slit-open position of the front hood 1, into the position of release for the closure hoop 4. For this purpose, the release 21 is coupled with the second hook part 15 via a pin/cam control. On the second hook part 15 there is developed in its central region for this purpose a pin 22 which extends into an approximately triangular control cam 23 of the release 21. The release 21 which is developed as bell-crank lever is in this connected acted on in clockwise direction by a torsion spring (not shown). In the locked position of the front hood shown in FIG. 1, the pin 22 extends within the region of the right inner vertex of the triangular control cam 23. The release then forms a hook extension 24 extending into the region of movement of the closure hoop 4 or its arm 6. This hook extension is acted upon upon the closing of the front hood 1 in the final closing phase. The swinging of the release 21 which takes place hand in hand with this leads, via the pin/cam control 22, 23, to a swinging of the second hook part 15 in form-locked engagement.

On its arm end 25, the release 21 forms a point of attack 26 for a handle 27 which engages, via a transfer means 28, on the point of attack 26 of the release 21.

The second hook part 15 forming the closure part has, in accordance with the position shown in FIG. 1, an opening outwardly directed control bevel 29. This bevel rises obliquely outward in the direction towards the projection 17. At an acute angle to the control bevel 29, the closure part 15 forms an opening inwardly directed supporting shoulder 30 which extends parallel to the opening 7. Both the control bevel 29 and the carrier shoulder 30 cooperate with the U-leg 6 of the closure hoop 4, as will be further explained below.

The following manner of operation prevails:

The opening of the front hood 1 requires a release of a closure, associated with the front hood, from the inside of the vehicle. After the front hood has been released, it swings under spring load into the slit-open position shown in FIG. 1. The closure-hoop arm 6 is, in this position, at such a distance from the second hook part 15 that the latter can swing into the release position with respect to the closure-hoop arm 6 shown in FIG. 5. This swinging is obtained by pulling the handle 27 in the direction of the arrow x. In this connection, the release 21 swings in counterclockwise direction around its support pin 20, in which connection the second hook part 15 is carried along opposite the spring-loading thereof by the pin/cam control 22, 23. The control bevel 29 of the second hook part 15 then extends parallel to the closure hoop 4. Similarly, the carrier shoulder 30 lies outside the path of movement of the closure-hoop arm 6. The opening 7 of the first hook part 8 is released so that the further swinging out of the front hood 1 can be carried out.

Figure 4:
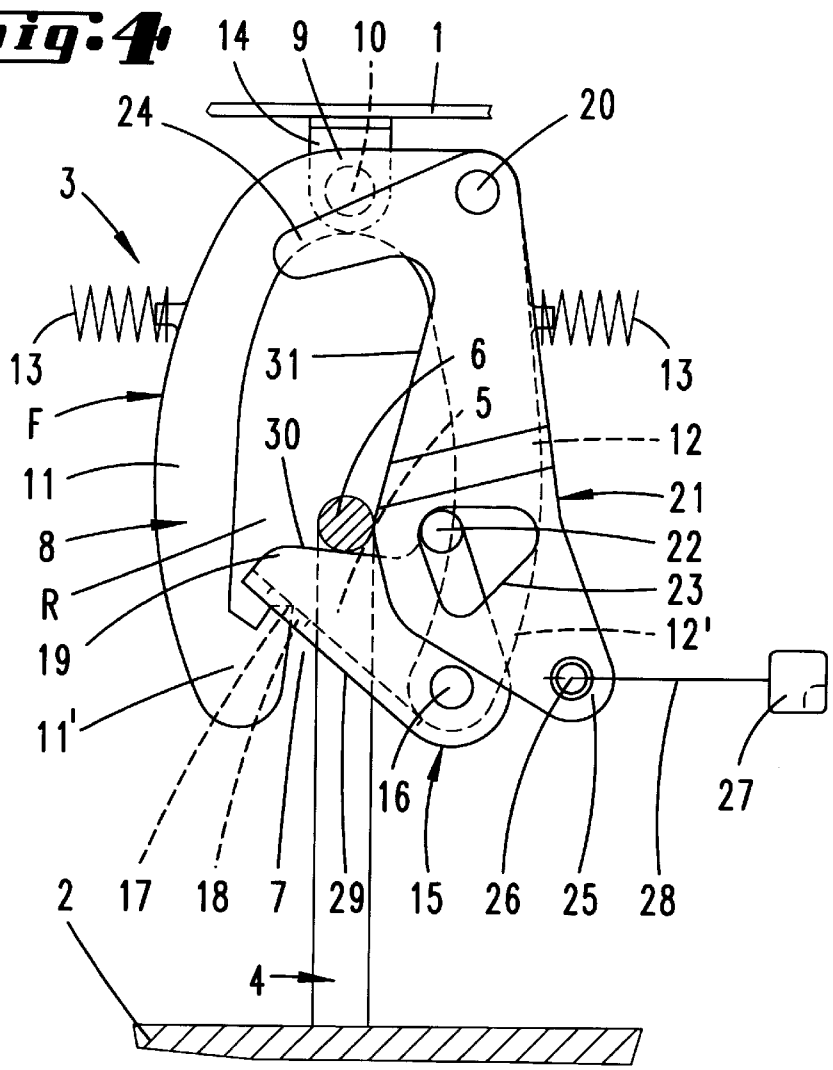
FIG. 4 shows an intermediate position of the catch-hook arrangement as results in the event that the front hood is shifted from the slit-open position further in the opening direction, namely without prior actuation of the release.
Figure 3:
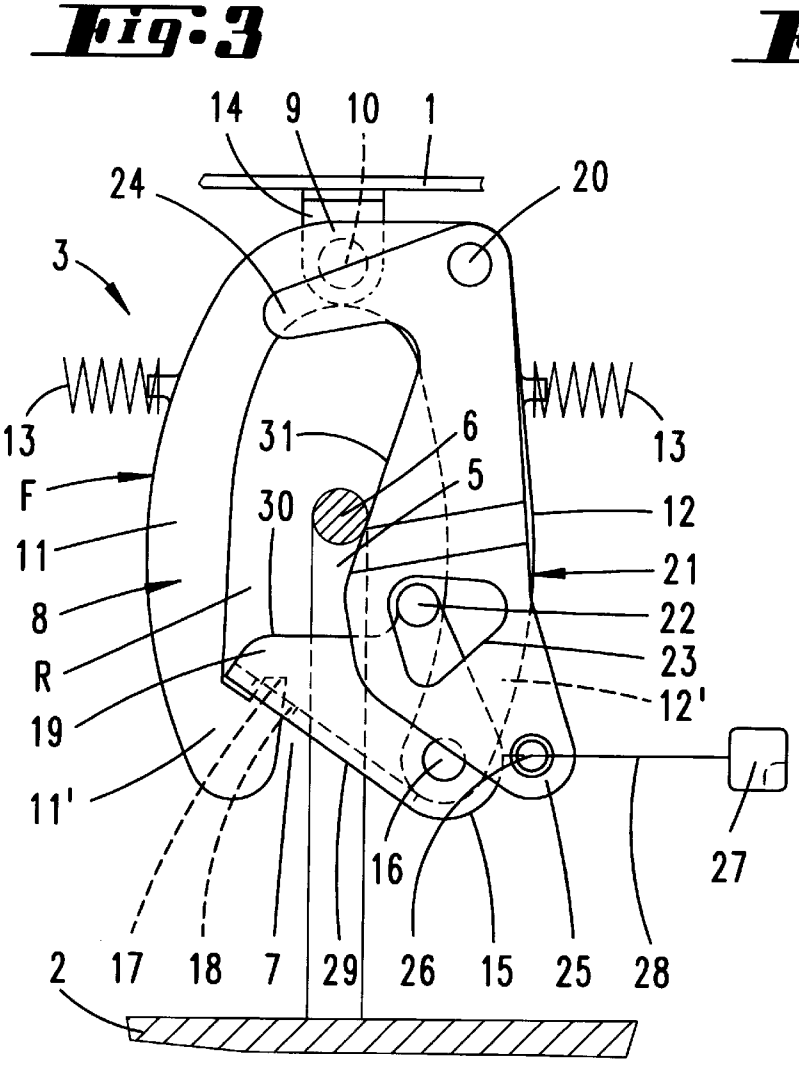
FIG. 3 is a showing of FIG. 1, but after release of a closure (not shown), in accordance with the slit-open position of the front hood.

If, starting from FIG. 3, a further opening of the front hood 1 is effected from the slit-open position without the release 21 being actuated, there is established a position in accordance with FIG. 4. The release 21 is acted on via the closure-hoop arm 6 on its end edge 31 facing the U-shaped intermediate space R and swung slightly, by an amount which, however, is not sufficient by means of the pin/cam control 22, 23 to bring the second hook part 15 out of form-locked engagement with the first hook part 8. The attempted further opening of the front hood 1 then has the effect that the closure-hoop arm 6 acts on the supporting shoulder 30 of the closure part 15 and forces the latter completely into form-locked engagement. The larger the opening forces, the stronger the form-locked engagement is. Therefore, the case can never occur that the front hood 1 passes into the open position during travel.

Figure 5:
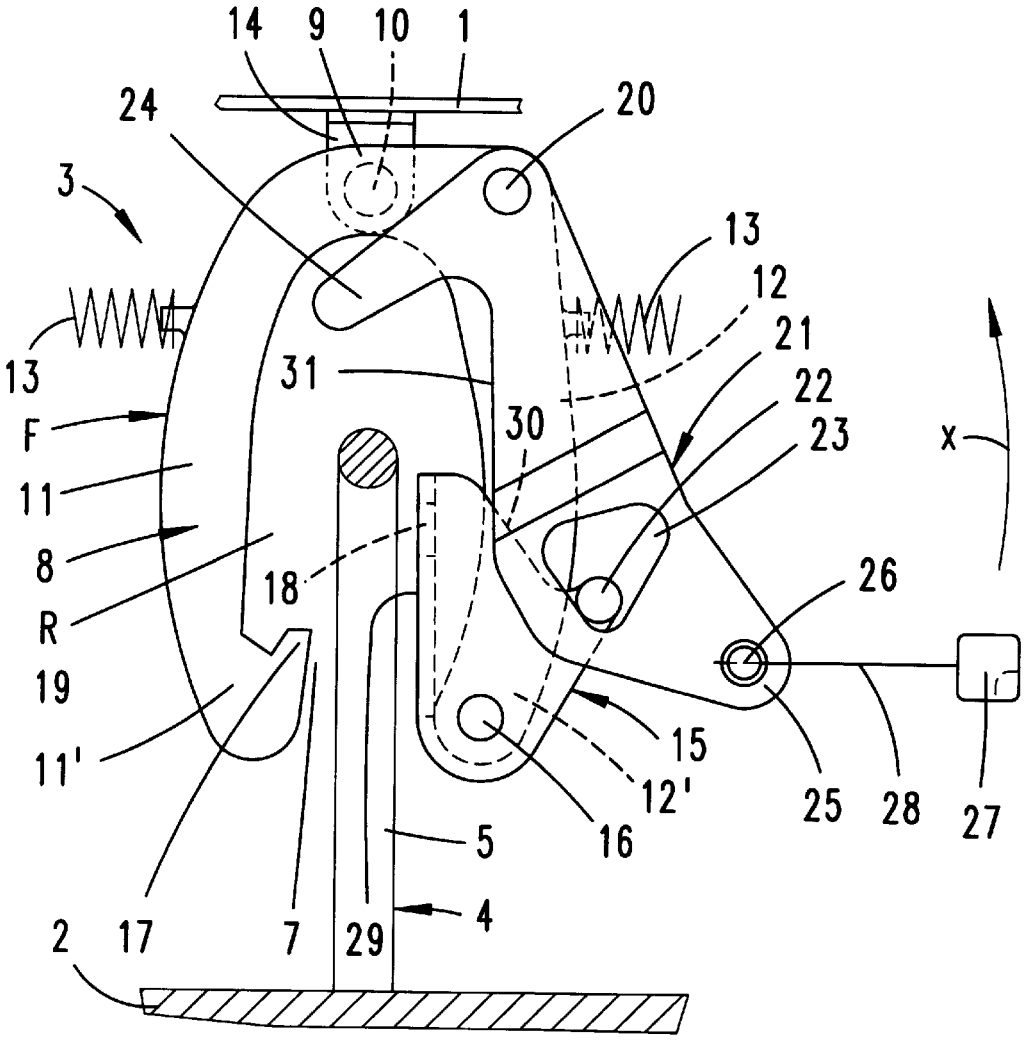
FIG. 5 shows the catch-hook arrangement in the slit-open position of the front hood with the release shifted and closure part carried along via it with the release of the opening of the catch hook for the passage of the closure hoop.

After opening of the front hood 1 from the position shown in FIG. 5, both the second closure part 15 and the release 21 turn back into the starting position shown in FIG. 1 in hand with the reduction of the form-locked engagement between the first hook part 8 and the second hook part 15. If the front hood is now closed, then the closure-hoop arm 6 acts on the control bevel 29 of the closure part 15 and swings it against spring load in clockwise direction, carrying the release 21 along via the pin/cam control 22, 23. In the final closing phase of the front hood 1, the closure-hoop arm 6 then passes into the region of the continuation of the hook 24 of the release 21. By action on the hook continuation 24, the release 21 swings positively towards its basic position and, via the pin/cam control 22, 23, brings the second hook part into form-locked engagement with the first hook part 8, together therewith that the opening 7 of the catch hook 8 is always properly closed.

In accordance with the second embodiment shown in FIGS. 6 to 10, the catch-hook arrangement bears the reference numeral 32. The closure hoop 33, which is also of U-shape, is fastened, contrary to the first embodiment, with U-legs 34 fixed on the front hood 35 shown in simplified manner in FIG. 7, while the U-leg 36 cooperates with a closure 37 developed as rotary-trap closure as well as with a catch hook F'. The latter has a first U-shaped hook part 38 which extends in one piece from a carrier plate 39. By means of laterally bent tabs 40, carrier plate forming the catch hook F' and the carrier plate 39 bearing the closure 37 can be fastened to the body of the car.

Figure 6:
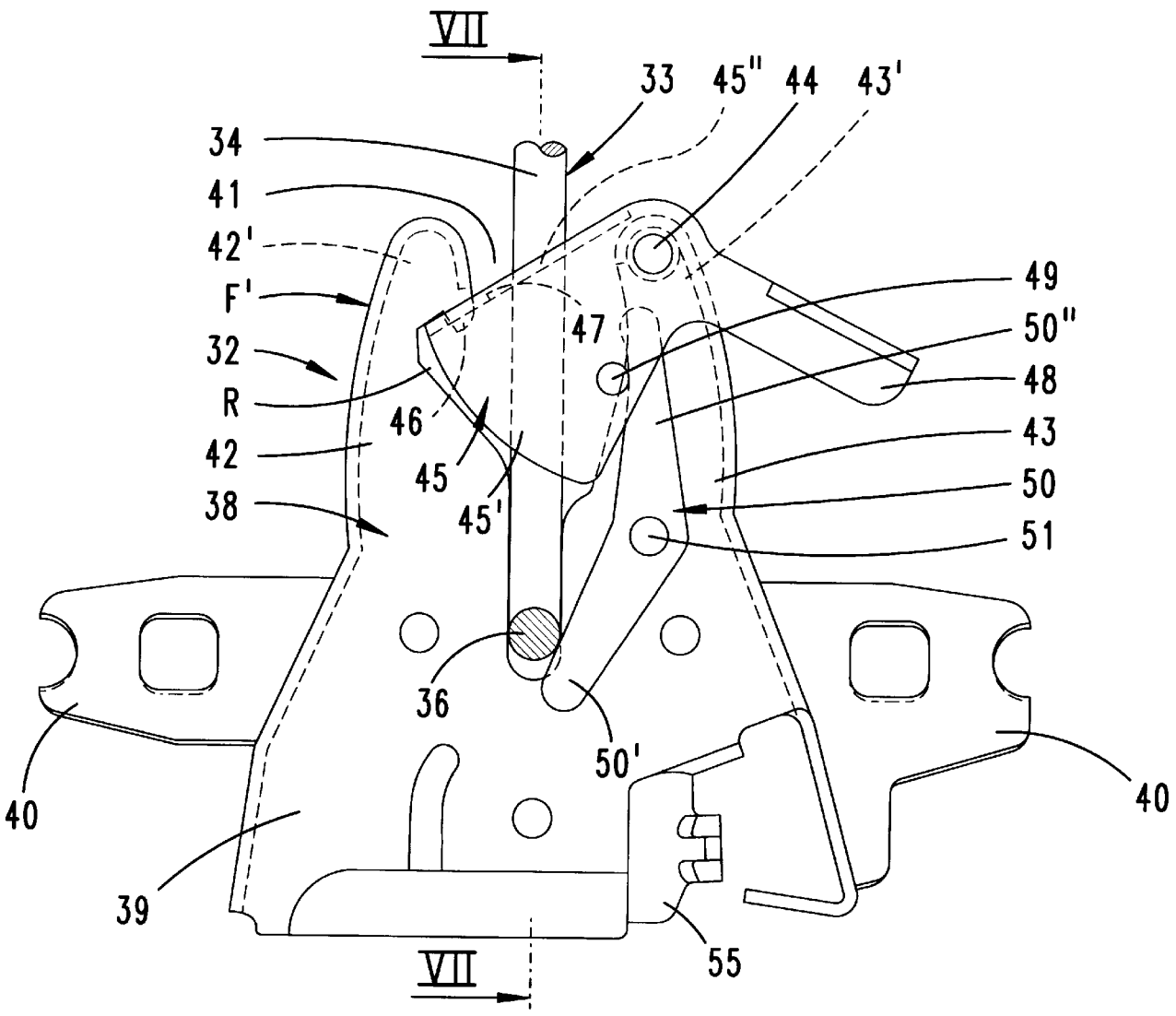
FIG. 6 is a front view of the catch-hook arrangement according to the second embodiment in the locking position of the front hood.
Figure 7:
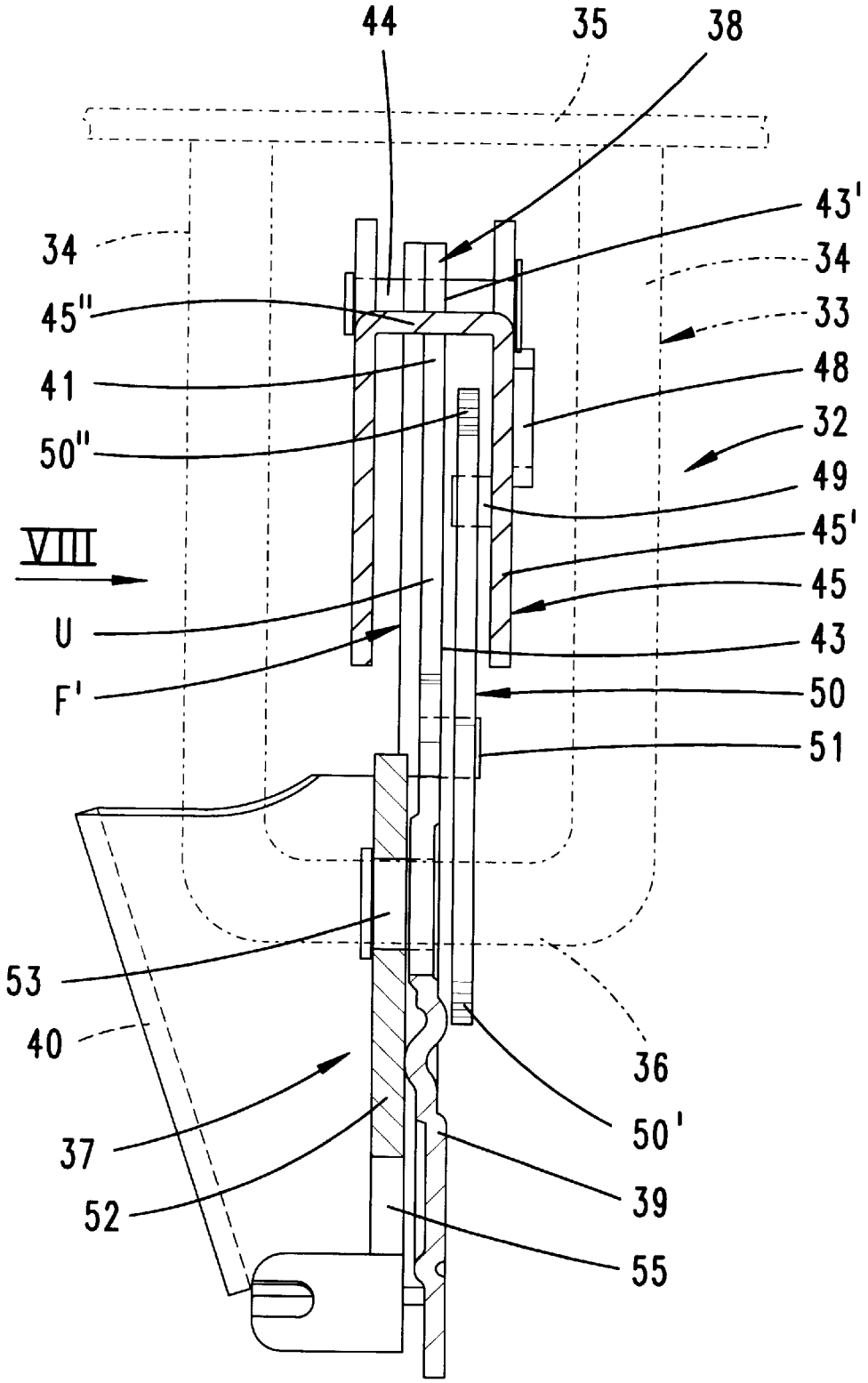
FIG. 7 is a section along the line VII—VII of FIG. 6, enlarged.
Figure 8:
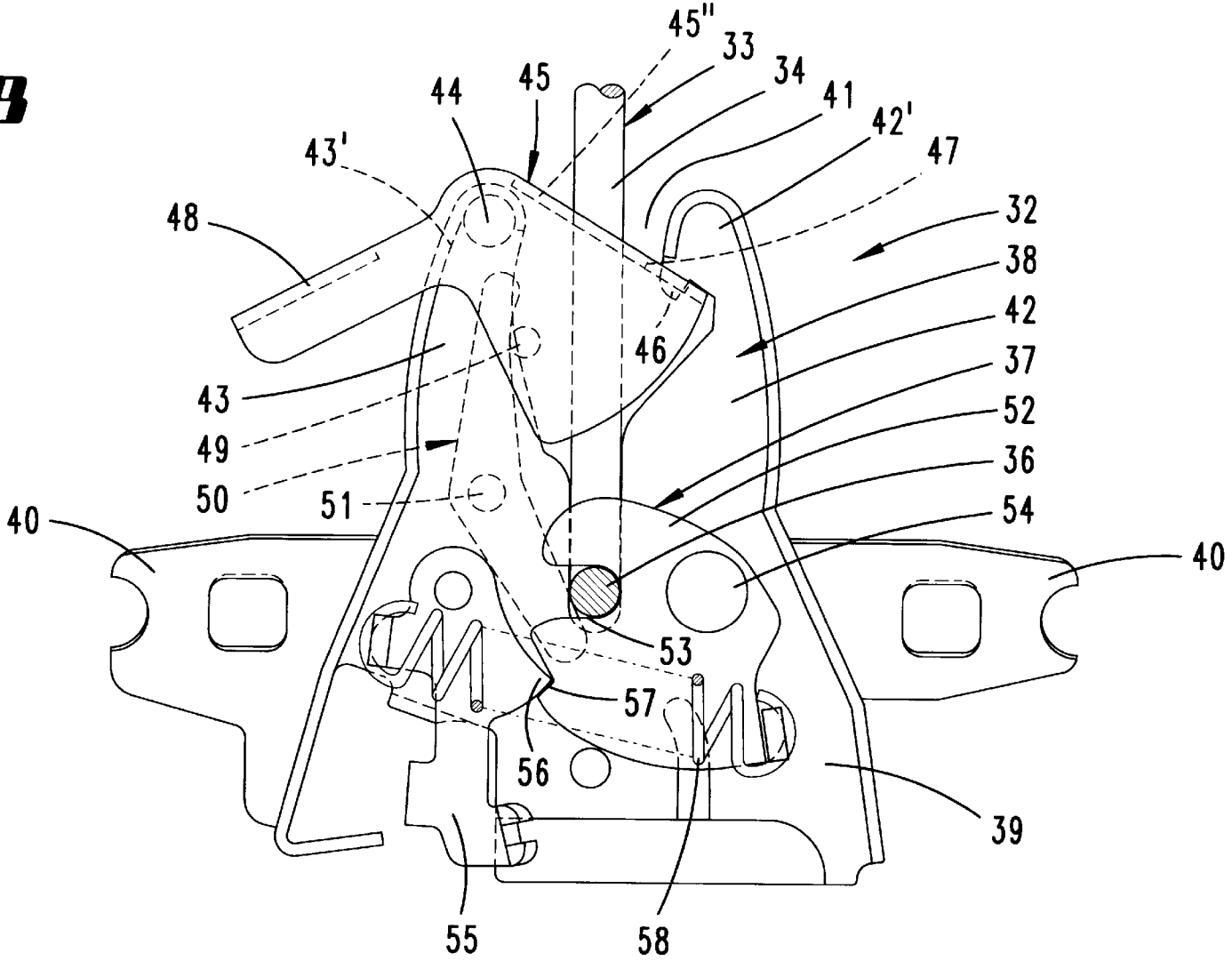
FIG. 8 is a view in the direction of the arrow VIII of FIG. 7, and therefore the rear view of FIG. 6.
Figure 9:
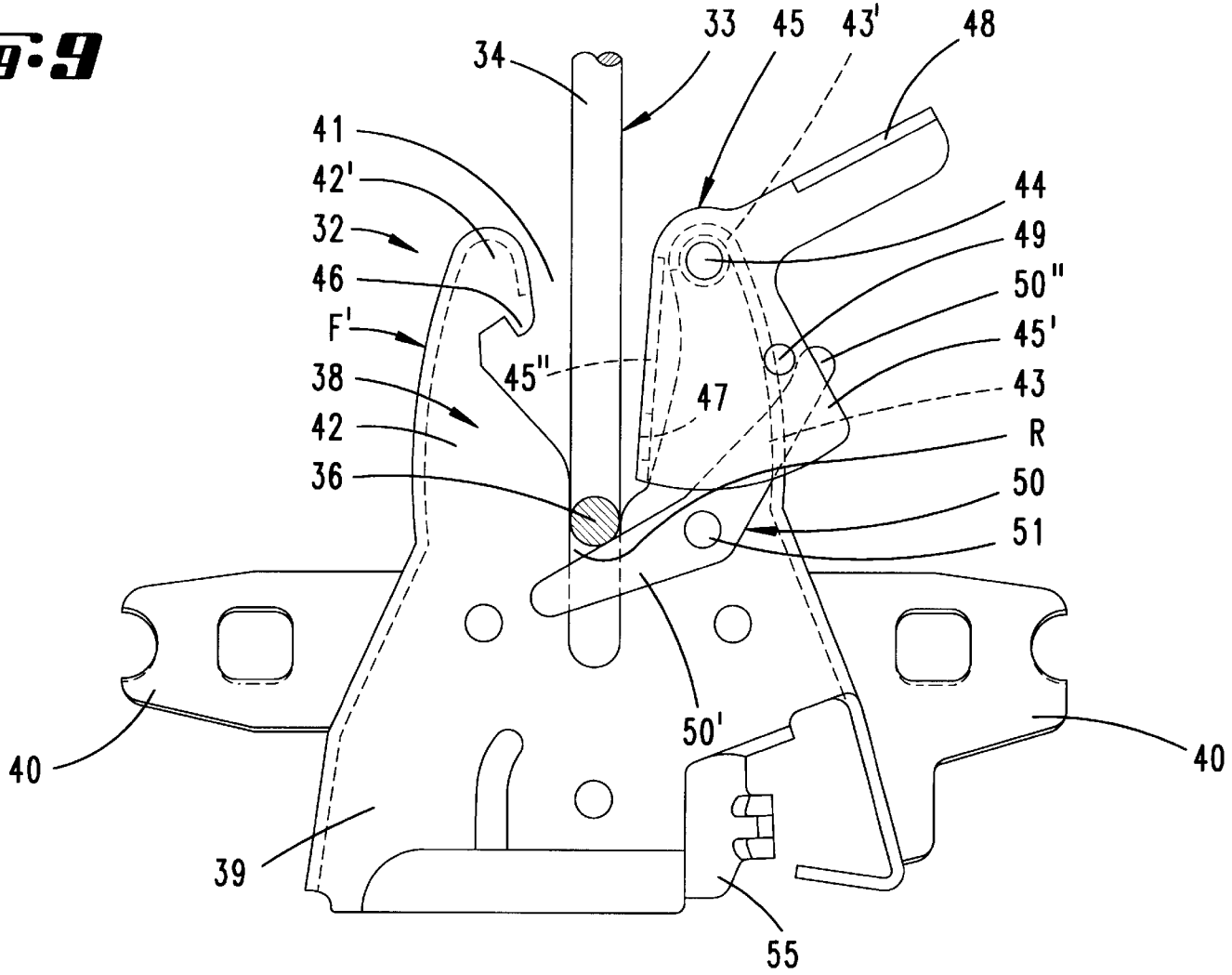
FIG. 9 is a showing similar to FIG. 6, but showing the position which results upon the release of the closure.
Figure 10:
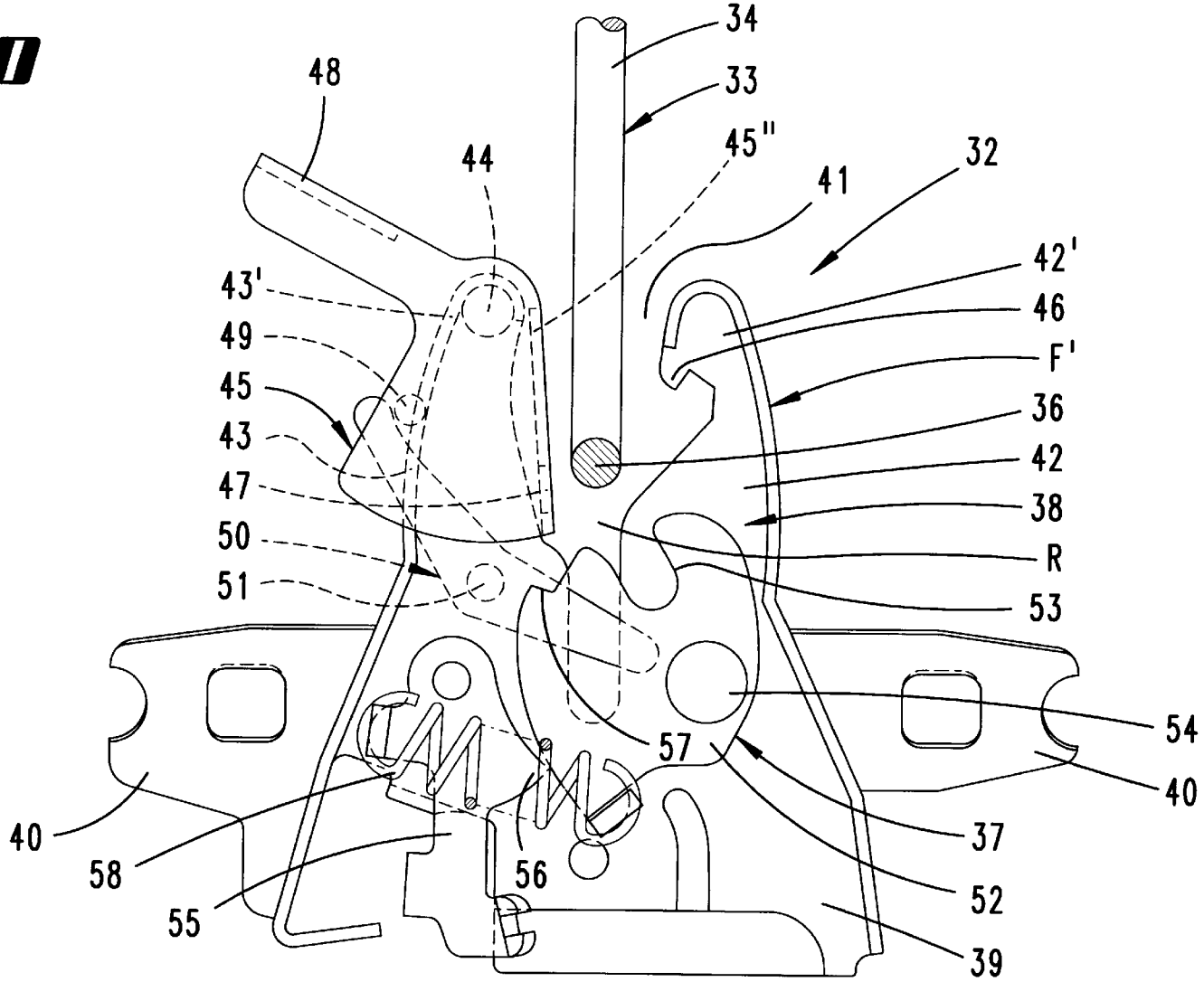
FIG. 10 is a rear view of FIG. 9 during the opening of the front hood.
Figure 12:
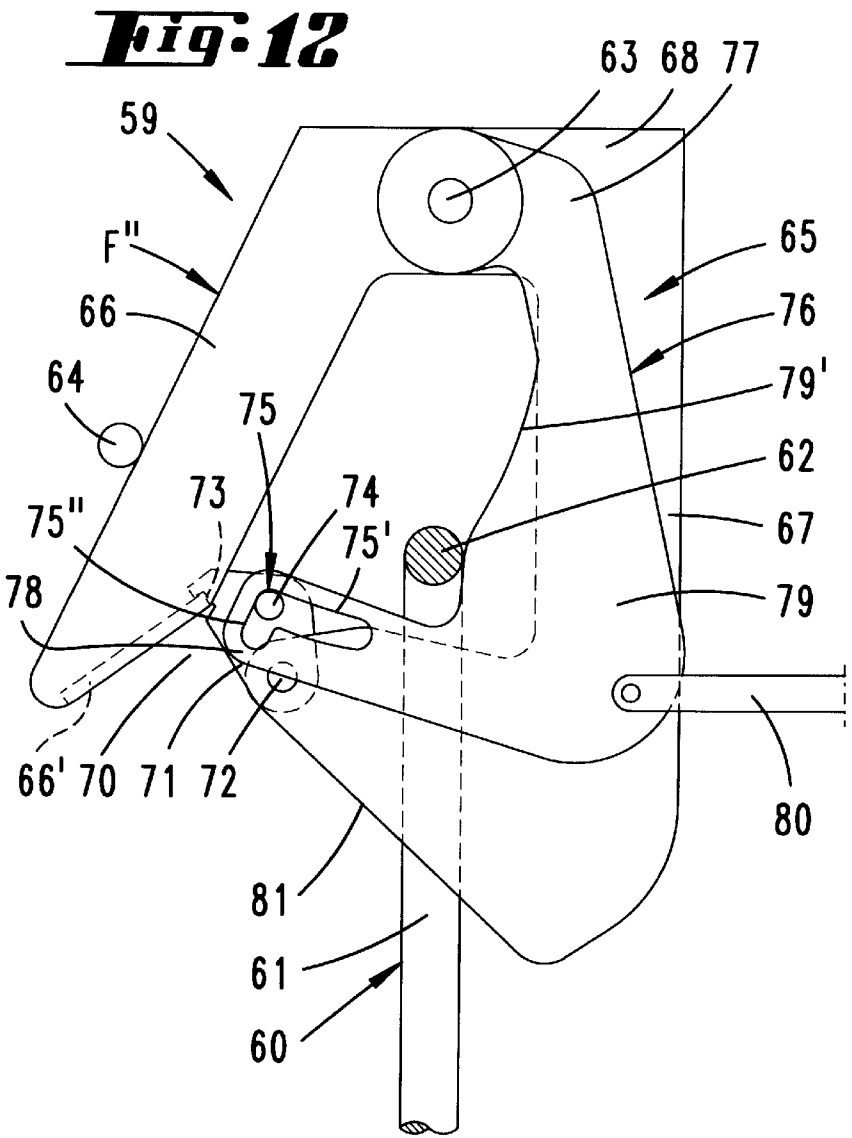
FIG. 12 shows the catch-hook arrangement in the slit-open position of the front hood, the front edge of the release being acted on, with swinging displacement of the closure.

The hook part 38 has a U-shaped opening 41 for the entrance of the U-leg 36 of the closure hoop 33. On both sides thereof, the U-legs 42 and 43 extend. The one U-leg end section 43' of the first hook part 38 mounts a second hook part 45, developed as closure part, on the pivot pin 44. A torsion spring, not shown, acts on this second hook part 45 of FIG. 6 in clockwise direction in such as manner that it swings into the U-shaped space R and in this connection enters into form-locked engagement with the other U-leg section 42'. The form-locked engagement is in this connection developed in the manner of a hooking. For this purpose, the U-leg end section 42' forms a projection 46 extending away from the U-opening 41 and which engages into a recess 47 in the second hook part 45. In the region of this recess 47, the second hook part 45 is developed in U-shape in cross section in such a manner that the recess 47 is present in the U-leg 45". The one U-leg 45' of this second hook part 45 which forms the closure part continues into a lever arm which forms a handle 48. On this U-leg 45' of the closure part—second hook part 45—there is fastened a pin-shaped driver 49 which, on its part, cooperates with a double-armed control lever 50. The articulating of the latter is effected around a pivot pin 51 of the U-leg 43 of the hook part 38. The control lever 50, in accordance with the showing in FIG. 6, is acted on in counterclockwise direction by a compression spring, not shown. In the locking position of the front hood shown in FIG. 6, the first lever arm 50' is struck upon by the U-leg 36 of the closure hoop 33, while the second lever arm 50" against the driver 49 of the closure part 45 in such a manner that the projection 46 of the U-leg 42 extends completely into the recess 47 in the closure part 45.

In the locked position, a rotary latch 52 of the closure 37 has been turned further by the U-leg 36 into the locking position. An open fork slit 53 on the edge side of the rotary trap 52 extends in this position approximately perpendicular to the direction of displacement of the U-leg 36. The rotary trap 52 is arranged for rotation around a rotary-trap 54 of the carrier plate 39. For the securing of the locking position of the rotary latch 52 there is employed 55 which, in known manner, by means of a locking tooth 56 cooperates with a locking recess 57 of the rotary latch 52; see FIG. 8. A tension spring 58 acts on the pawl 55 and on the rotary latch 52. The rotary latch 52 is thereby spring-loaded in the direction of opening and urges the pawl 55 in the position of engagement. In order to bring the front hood 35 into its open position, it is necessary, first of all, preferably from the inside of the vehicle to bring the closure 57 into the release position. In this connection, via a lever and with a Bowden cable coupled to it, the pawl 55 is swung so that its locking tooth 56 leaves the locking recess 57 of the rotary trap 52. The latter, under the action of the tension spring 58, swings into the open position shown in FIG. 10, the front hood coming into a slit-open position. Thereupon it is possible by means of the handle 48 to turn the closure part 45 into the position shown in FIGS. 9 and 10 with release of the U-opening 41 of the first hook part 38. By a swinging of the closure part 45, the control lever 50 moves into the position shown in FIG. 9, the second lever arm 50" resting against the driver 49.

When the hood has been opened, the closure part 45 returns, as a result of the spring loading, into its locked position. Also, the control lever 50 swings into the position shown in FIG. 6. In this position, the U-leg 45" of the closure part 45 closes the U-opening 41. Furthermore, the U-leg 45" rises in this direction, starting from the form-locked engagement, obliquely in the direction of the U-leg end section 43'. If the front hood 35 is now closed, then the U-leg 36 strikes the closure part 45 on its U-leg 45" and swings it into a position releasing the passageway for the closure hoop 33. This displacement is transmitted to the control lever 50. As soon as the U-leg 36 of the closure hoop 33 has passed by the closure hoop part 45, the latter is released for backward swinging. During the course of the further closing movement, the U-leg 36 of the closure hoop 33 engages into the fork-slit 53 of the rotary trap 52 and turns it in its closing direction. Furthermore, by means of the U-leg 36, the lever arm 50' of the control lever 50 which lies crosswise to the path of entrance of the closure hoop 33, is displaced, it forcing the closure part 45 into form-locked engagement with the projection 46 of the U-leg 42, so that assurance is had that, even in the event of difficulty of movement of the closure part 45 it assumes its intended locking position.

In the final phase of the closing movement of the front hood 35, the rotary trap 52 is displaced to such an extent that its locking recess 57 permits the entrance of the locking tooth 56 of the pawl 55, so that the closure 37 also assumes its locking position.

The catch-hook arrangement 59, in accordance with the third embodiment, shown in FIGS. 11 to 16, has a closure hoop 60 of U-shape fastened to the body of the car, the U-legs 61 of which are fastened on the body side and the U-leg 62 of which is directed horizontally. The catch hook F" which cooperates with the U-leg 62 is pivoted by means of a pivot pin 63 to the front hood (not shown). On the catch hook F", there acts a torsion spring (not shown) arranged on the pivot pin 63, which brings the catch hook F" in clockwise direction into a position limited by the stop 64; see FIG. 1.

The catch hook F" has a first hook part 65 with two downward-directed legs 66, 67 which are connected with each other by a leg 68 in the upper region. The leg is passed through by the pivot pin 63. The obliquely downwardly extending leg 66, in the release position, strikes against the aforementioned stop 64, while the other leg 67 is directed vertically. From this leg 67 an extension 69 extends obliquely in the direction of the leg 66. The extension leaves, together with the leg 66, an opening 70 which can be closed by means of a second part hook part 71, formed as closure part. For this purpose, the second hook part 71 is mounted around a pivot pin 72 of the leg-end section or extension 69. There is concerned a single-leg development of the hook part 71. On its free end, this forms a detent niche 73 which, in the closed position of the second hook part 71 shown in FIG. 11, enters into detent engagement with an edge of an arm 66' of the leg 66.

The second hook part 71 bears a coupling pin 74 for cooperation with an angular slot 75 of a release 76 which is swingable around the pivot pin 63. The latter also is urged in clockwise direction by a torsion spring (not shown). There is approximately a U-shaped development of the release 76. The one U-leg 77 serves for mounting on the pivot pin 63, while the other U-leg 78 has the angular slit 75. The U-leg 79 partially covers the hook opening and when the front hood is closed, extends into the region of motion of the U-leg 62 of the closure hoop 60. The latter is such in detail that the one edge 79' of the U-leg 79 extends obliquely to the direction of the closure hoop 60.

In the closed position of the catch-hook arrangement 59, the coupling pin 74 extends out the end of the one angle-slit section 75', which is aligned eccentric to the pivot pin 63. The other angle-slit section 75" adjoins closely in right-angle direction the angle-slit section 75'. A handle (not shown) is coupled with the release 76 via a force transmission means 80.

Figure 11:
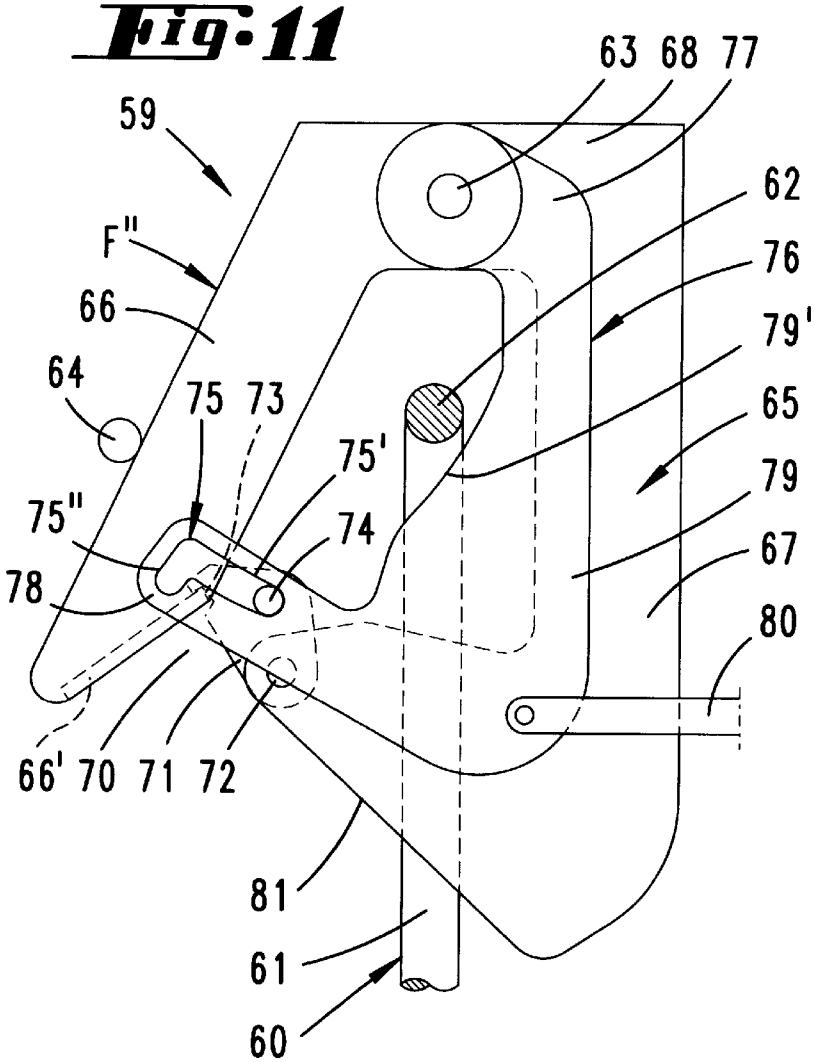
FIG. 11 shows the essential components of the catch-hook arrangement according to the third embodiment, concerning the locking position of the front hood.
Figure 14:
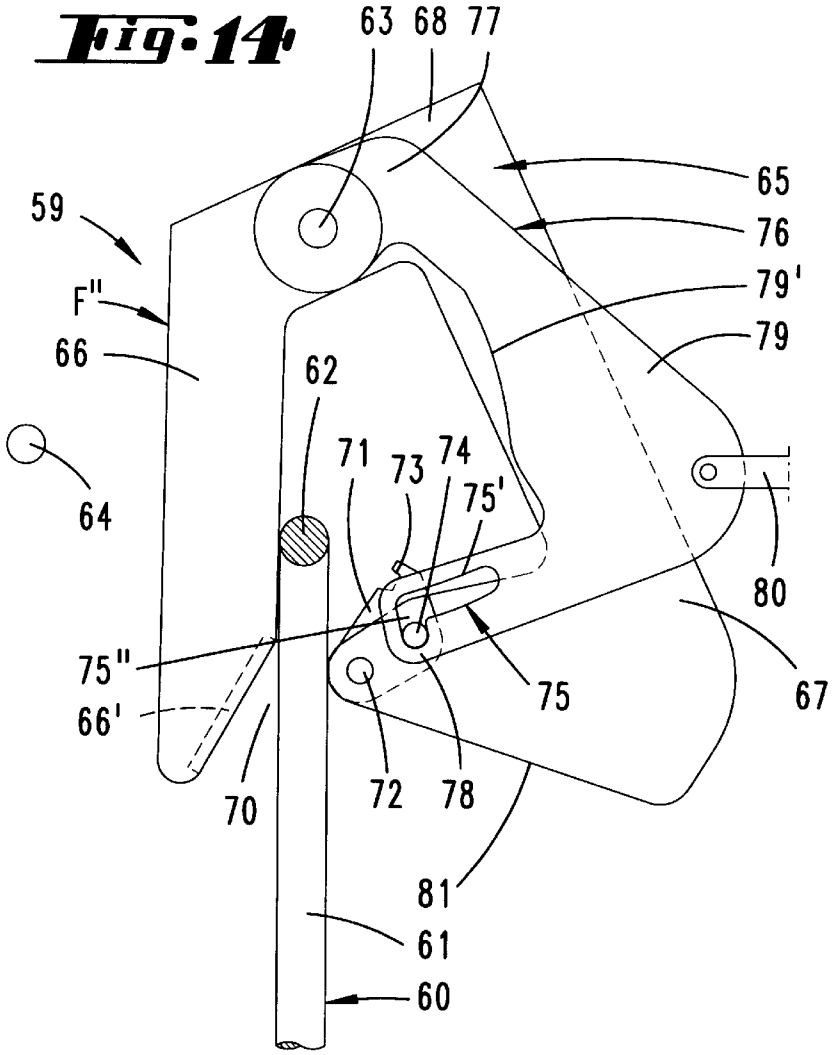
FIG. 14 shows the catch-hook arrangement in the position in which it releases the closure hoop.

The catch-hook arrangement in accordance with this third embodiment operates as follows:

FIG. 11 shows the closed position of the front hood. The opening thereof requires the prior release of the closure (not shown). As a result, the front hood swings into a position shown in FIG. 12, in which the closure hoop 60 has moved relative to the catch hook F". In this slit-open position, the U-leg 62, via the edge 79" of the release 76, swings the latter into the position shown in FIG. 12 with the assistance of the force-transmission means 80, which transfers the handle (not shown) into the region of actuation. In this position, the coupling pin 74 has entered into the angular region of the angle slit 75. An unintended opening from this slit-open position is not possible, so that any possibility of injury is also prevented thereby. The U-leg 78 of the release namely forms a carrier shoulder which lies in the region of motion of the closure hoop 60.

Figure 13:
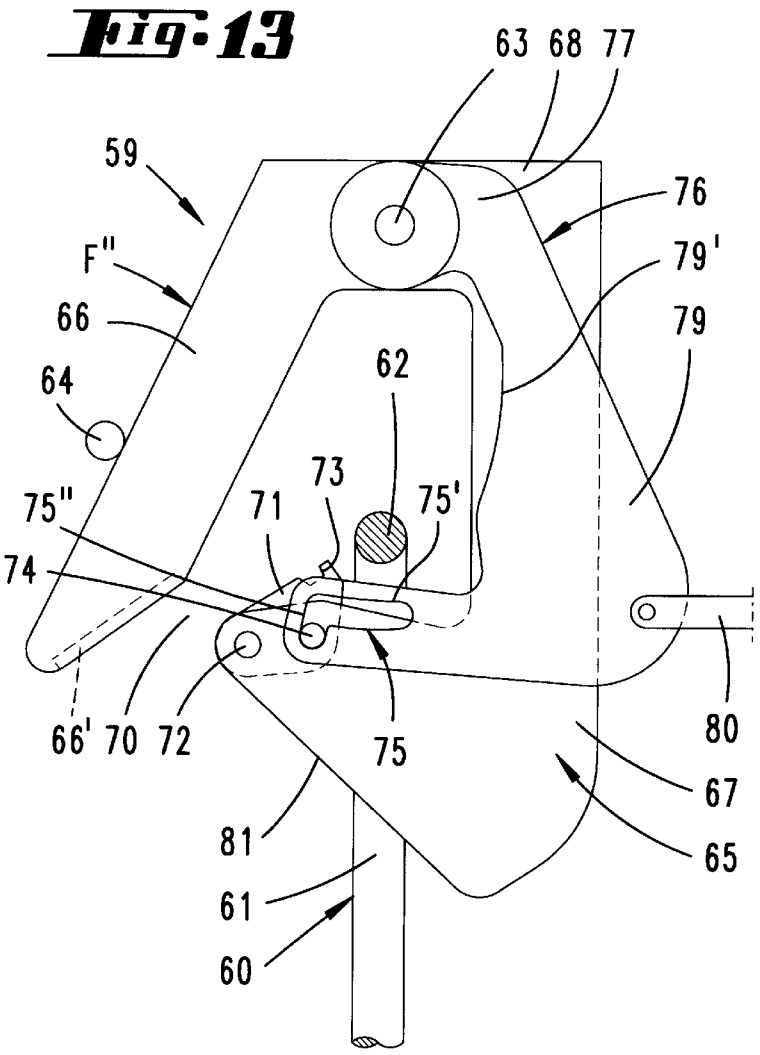
FIG. 13 is a view following FIG. 12, with the second closure part brought out of engagement by the release.
Figure 16:
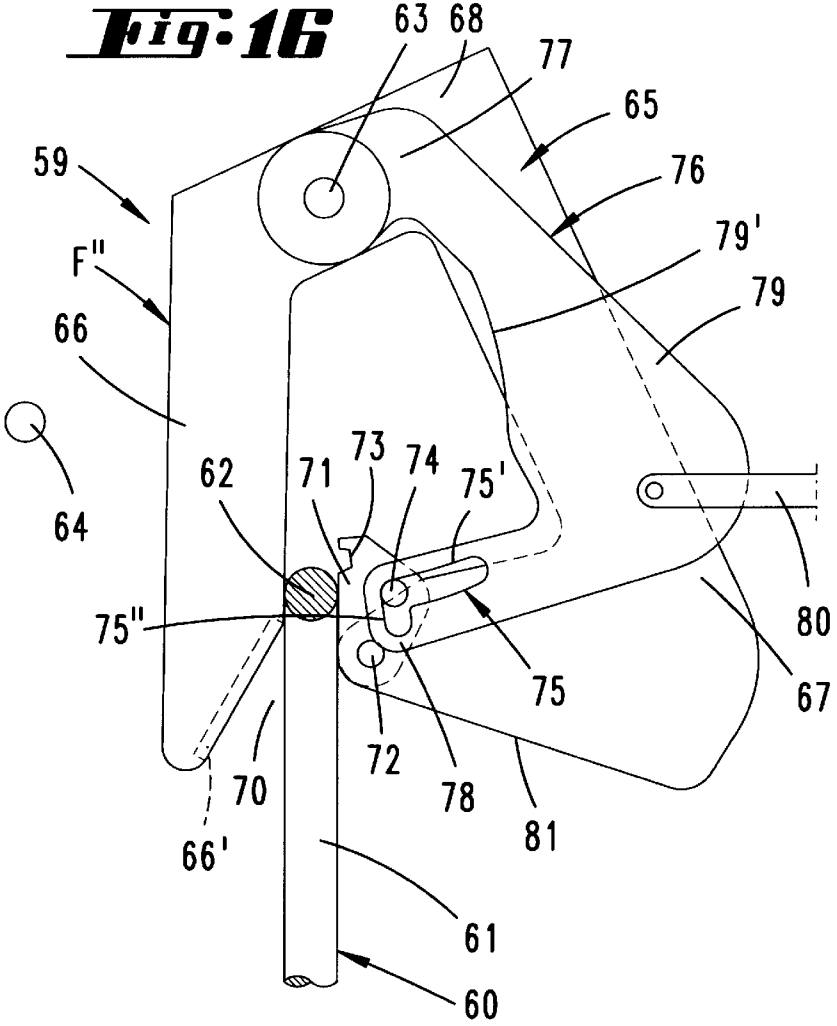
FIG. 16 shows the position following FIG. 15 during the lifting out of the second closure part by the closure hoop.
Figure 15:
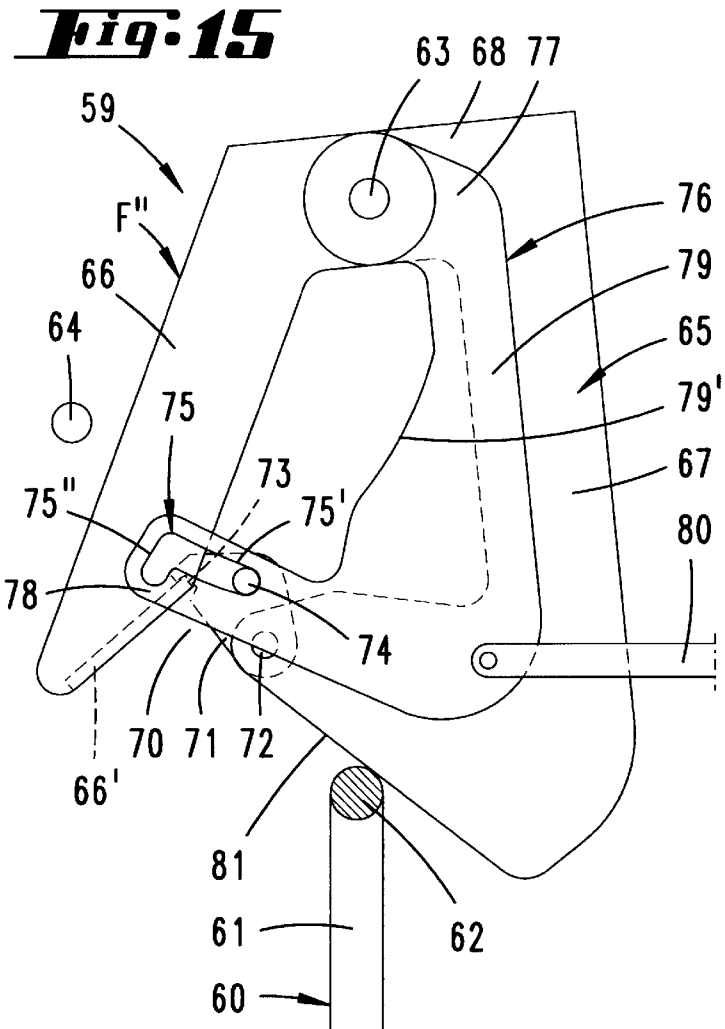
FIG. 15 shows the catch-hook arrangement upon the closing of the opened front hood, the closure hoop swinging the first swing part via a control bevel of the extension.

The swinging-up of the front hood requires a further displacement of the release 76 into the position shown in FIG. 13, in which the second hook part 71 is carried along via the angle slit 75 with the release of the opening 70. The coupling pin 74 upon this displacement moves into the downward directed angle-slit section 75". However, the release movement is not to be continued further, in which case, via the second hook part 71, the first hook part 65 is carried along into the position shown in FIG. 14 in such a manner that the U-leg 62 of the closure hoop 60 extends above the opening 70, which permits the opening of the front hood. In the opened position of the front hood, the parts of catch-hook arrangement 59 return into the position shown in FIG. 11. If, from this position, the closure hoop is closed, then after extensive closing of the front hood, the U-leg 62 strikes a control bevel 81 of the extension 69 together with the swinging of the first hook part 65 into the position shown in FIG. 15. Upon further pressing down of the front hood into the closure position, the U-leg 62 then swings the second hook part 71 forming the closure part into the position releasing the opening 70; see FIG. 16. After the U-leg 62 of the closure hoop 60 has entered the inside of the catch hook, the parts of the catch-hook arrangement 59 move back into the spring-loaded closed position shown in FIG. 11. In this position, the closure (not shown) has also been moved into its locked position.

The catch-hook arrangement 82 shown in FIGS. 17 to 20 of the fourth embodiment contains a U-shaped closure hoop 83 the arm of which cooperates with a catch hook F'". The catch hook F'" has a first hook part 84 with two downwardly directed legs 85, 86 which between them leave a catch opening 87 for the entrance of the closure hoop 83. Within the upper region, the leg 85 mounts a release 89 around a pivot pin 88. A torsion spring 90 associated with the pivot pin 80 urges the release 89 in counterclockwise direction. The swinging of the release 89 is limited by a stop projection 91 in cooperation with the leg 92 of the first hook part 84 connecting the two legs 85, 86; see FIG. 17. The release 89 is provided in the upper region with an edge-side open niche 93 for the entrance of the closure hoop 83. Above the niche 93, the stop cap projection 91 extends, while below the niche a control cam 94 is developed on the release 89. A pin 95 of a second hook part 96 cooperates with the control cam 94, it being supported around the pivot pin 97 at the lower end of the leg 85. The second hook part 96 has a somewhat segment-shaped basic contour. A torsion spring 98 associated with the pressure pin 97 urges the second hook part 96 in clockwise direction, so that a projection 86' of the leg 86 engages into a recess 99 in the second hook part 96. In this position, the closure hoop 83 cannot leave the catch-hook opening 87. The closure hoop 83 could, to be sure, move the release 89 out. Then, however, its strikes against the second hook part 96 and acts upon it in the direction of its locking position.

Figure 17:
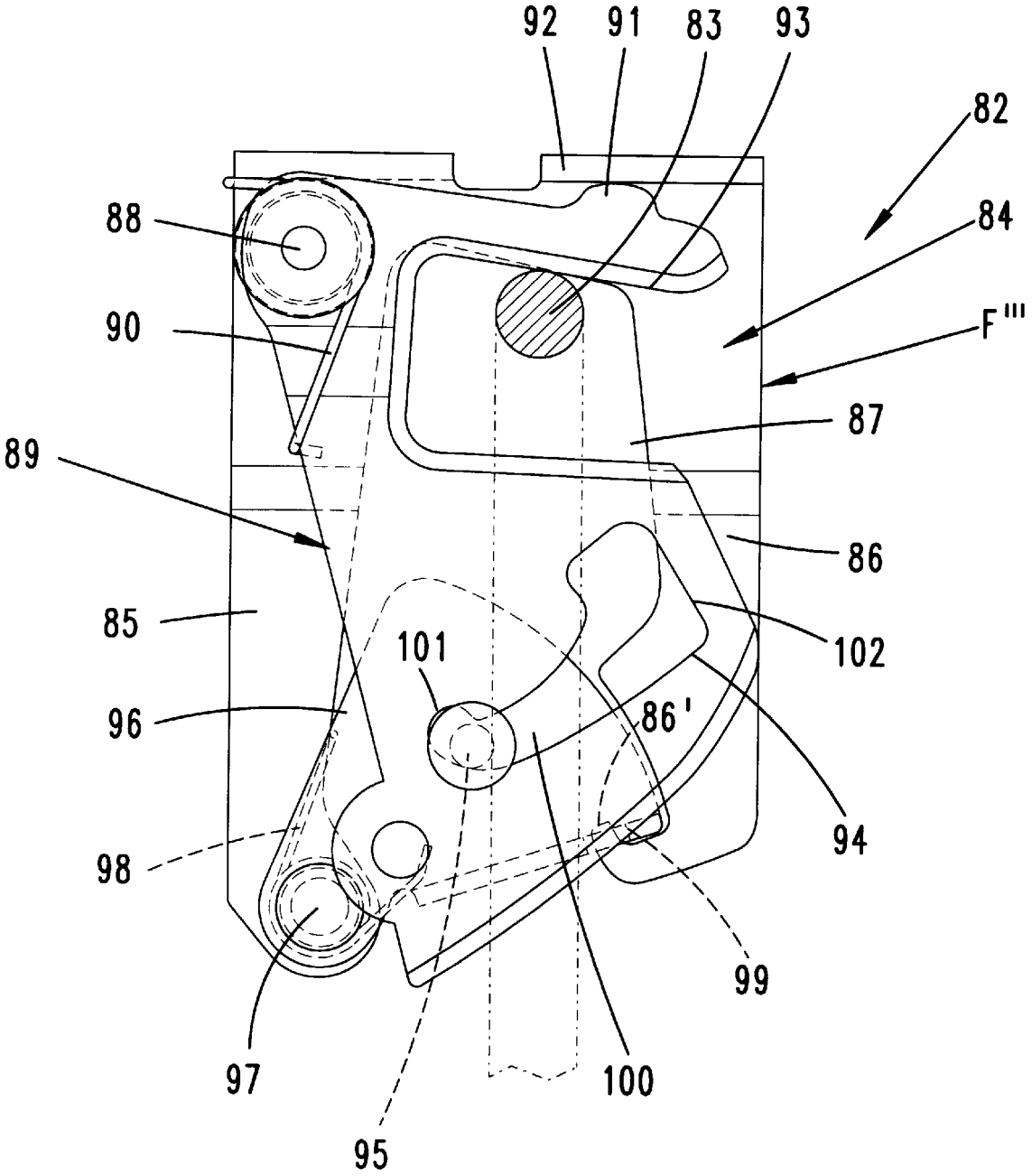
FIG. 17 is a view of the catch-hook arrangement according to the fourth embodiment, relating to the locking position of the front hood.
Figure 18:
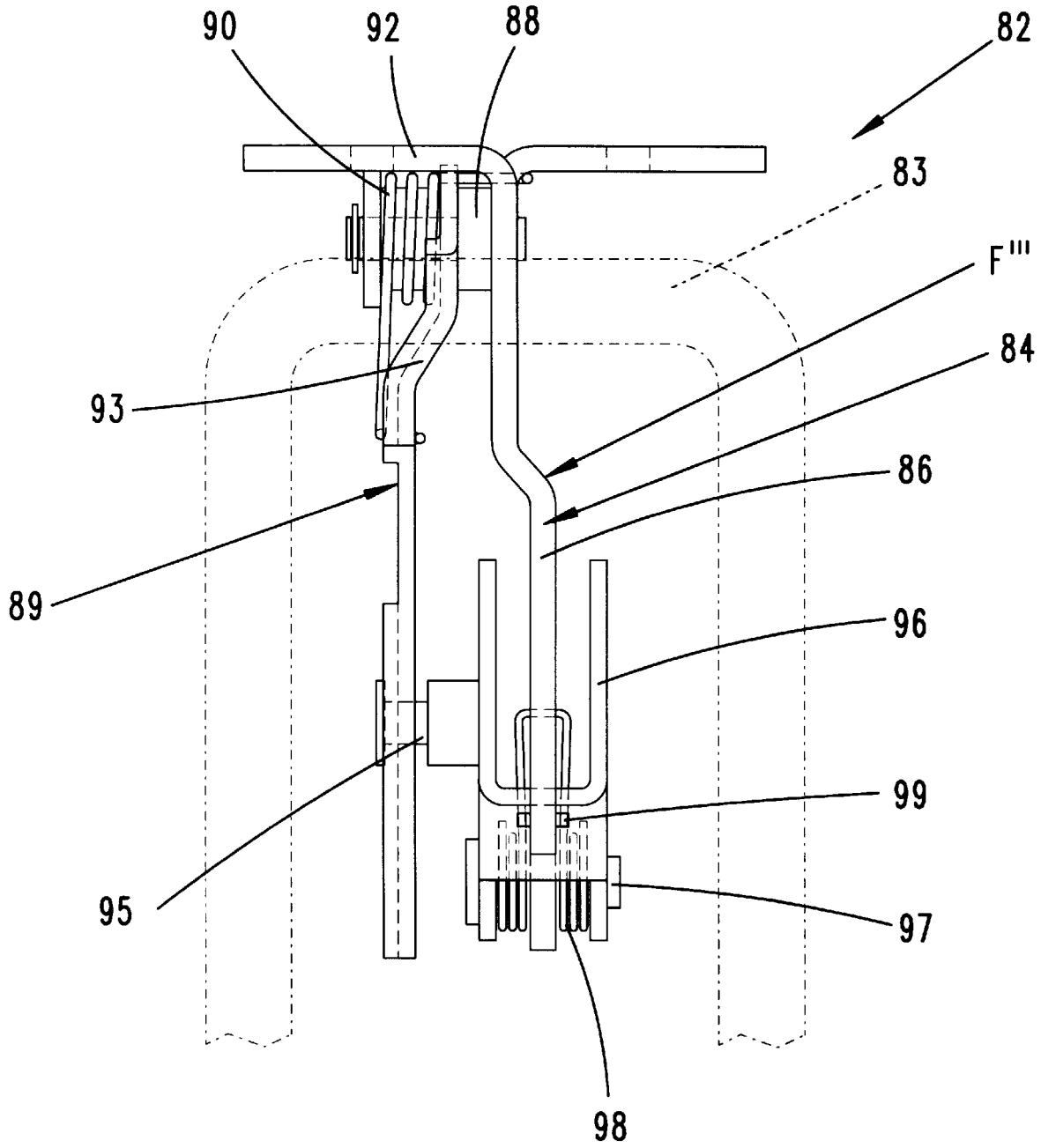
FIG. 18 shows the position of FIG. 17 swung by 90°.
Figure 19:
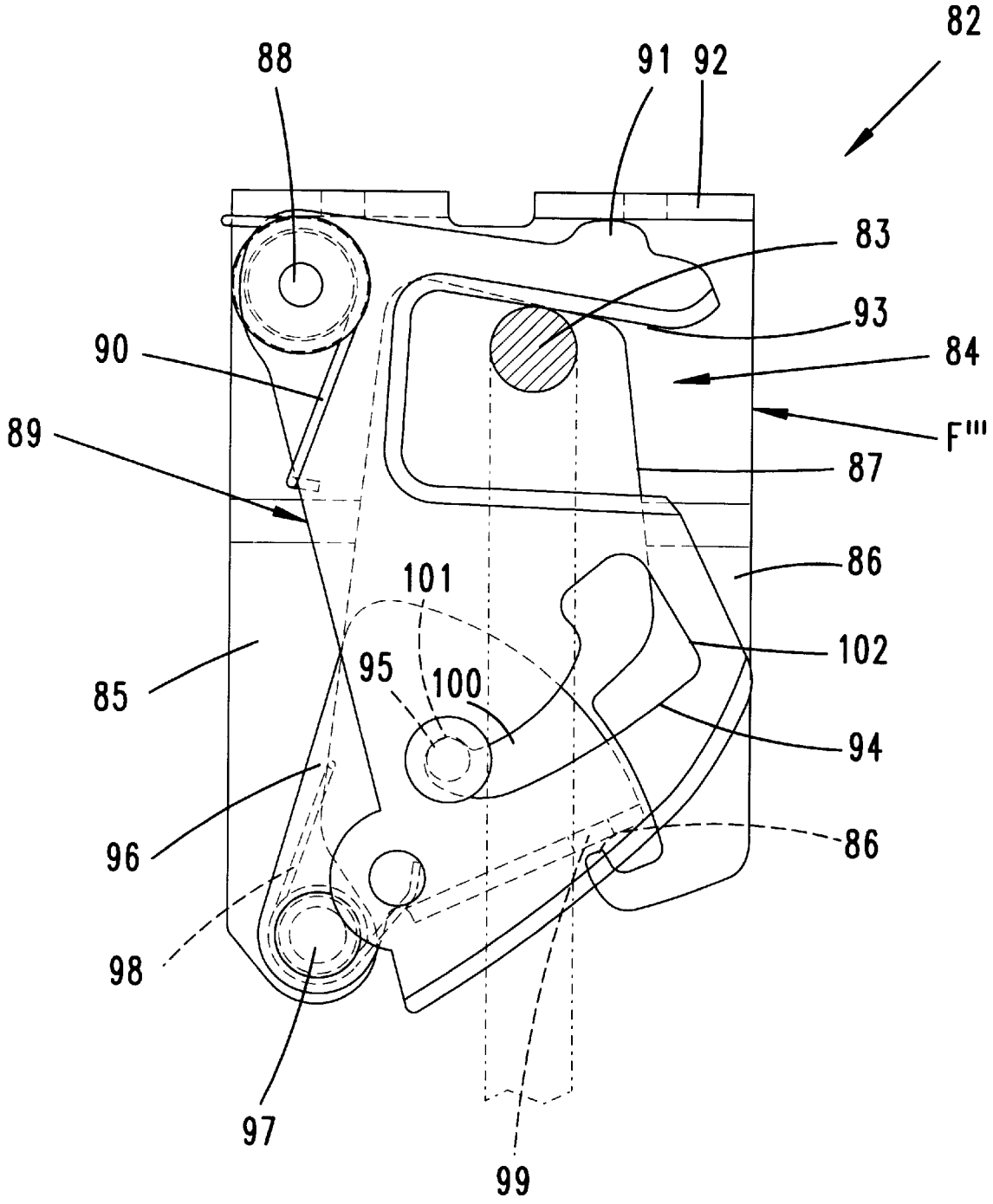
FIG. 19 is a view corresponding to FIG. 17, but with the release assuming its blocking position and second hook part.
Figure 20:
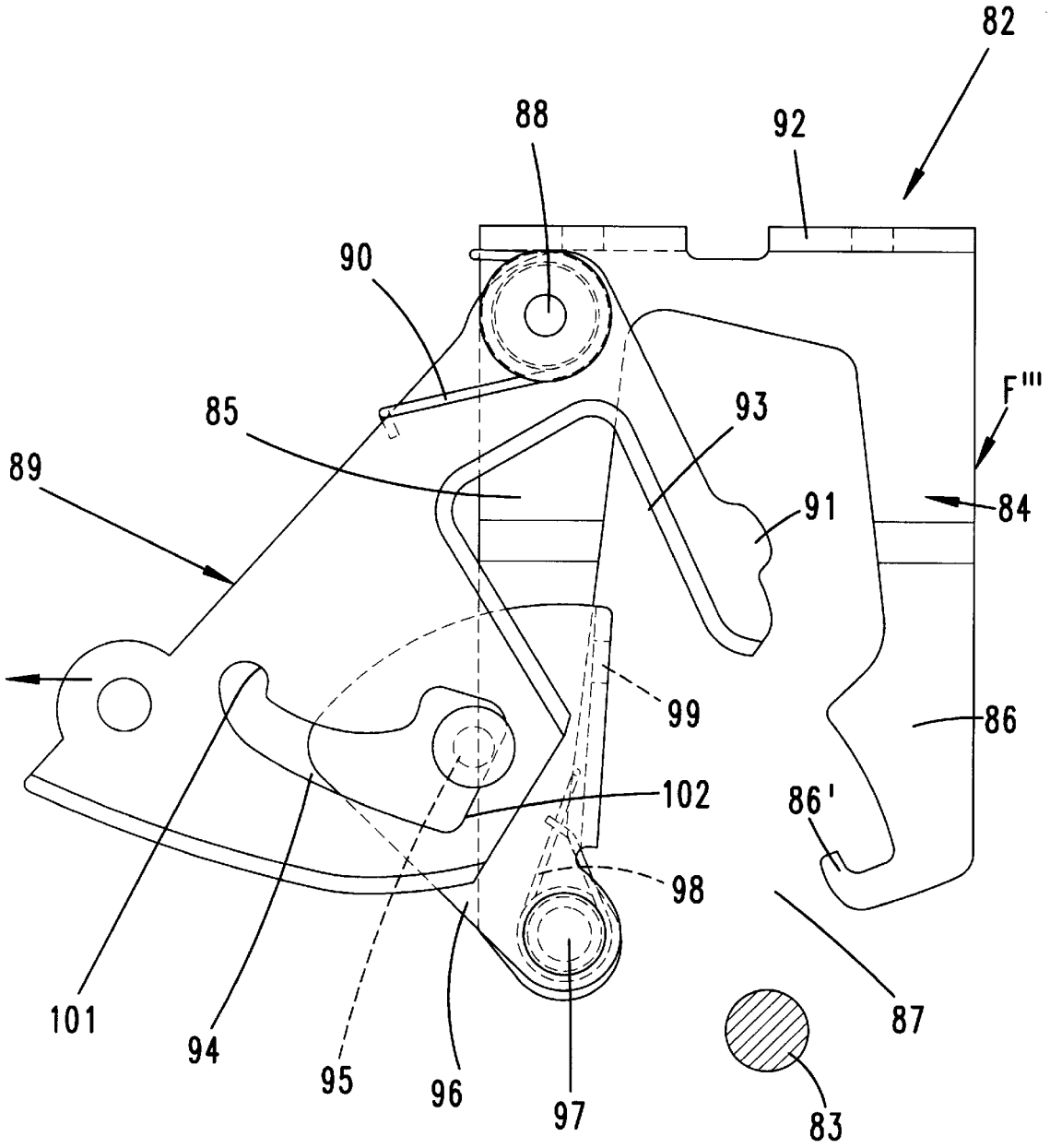
FIG. 20 shows the catch-hook arrangement in its position releasing the closure hoop.

In the locking position shown in FIG. 17, the pin 95 extends at one end 100 of the angularly shaped control cam 94. The end 100 continues into an obliquely upward directed blocking niche 101, which extends approximately concentric to the pivot pin 97. Such a dimensioning of the torsion springs 90, 98 is selected that the restoring spring 98 of the second hook part 96 is designed with lesser force.

The manner of action of catch-hook arrangement 82 is as follows:

Upon a crash of the vehicle provided with the catch-hook arrangement 82, forces of inertia act on the second hook part 98 and on the release 89, leading to a self-locking of the second hook part 96 and release 89. This takes place in the manner that the second hook part 96 moves ahead of the release 89 due to the smaller dimensioned restoring spring 98, the pin 95 extending into the blocking niche 101 of the release 98 and bringing these two parts into a blocking position, together with the fact that the closure hoop 83 cannot leave the catch-hook opening 87; see FIG. 19.

An opening of the engine hood is possible only by an intentional displacement of the release 96 in clockwise direction. For this purpose a rod (not shown) can act on the release 89. In this case, the pin 95 is struck by the control-cam section 102 of the pin 95 and the second hook part 96 thus swings against spring load, with release of the catch-hook opening 87, so that the closure hoop 83 can pass by the catch-hook opening 87. If no opening forces act on the release 89, then both the release 89 and the second hook part 96 return under spring action to their position shown in FIG. 17. Upon the closing of the hood, then both the release 89 and the second release are swung by the closure hoop 83 into the position releasing the catch-hook opening 87. In the final phase of the closure actuation, the closure hoop 83 strikes against the upper edge of the niche 93 and thereby forces the release 89 into its intended end position.

The catch-hook arrangement 103 shown in FIGS. 21 to 24 contains a closure hoop 104 as well as a catch hook F"". In suitable manner, the catch hook F"" is associated with the front hood (not shown). The catch hook F"" forms a first hook part 105 with downward directed legs 106 and 107, which leave a catch-hook opening 108 between them. In the region of the root of the leg 106, the first hook part 105 mounts a release 110 around a pivot pin 109. A torsion spring, not shown, but associated with the pivot pin 109, loads the release 110 in counterclockwise direction. In this version, the release 110 is provided with a niche 111 open on the edge side, below which the release 110 forms a control cam 112. The latter then cooperates with a pin 113 of a second hook part 114. The latter is mounted around a pivot pin 115 at the lower end of the leg 107. By means of a bend 116, the second hook part 114 moves in the locked position of the catch-hook arrangement 103 into a recess 117 in the leg 107 as a result of spring loading. There is concerned here a torsion spring (not shown) which is seated on the pivot pin 115.

Essentially, the control cam 112 is also of angular development in this fifth version. In the locked position of the catch-hook arrangement 103, the pin 113 extends at one end 118 of the control cam 112. In this way the spring-loaded swinging of the release 110 is also limited; see FIG. 21.

The control-cam section 119 which is closer to the pivot pin 109 is extended over by a blocking shoulder 120. This leaves such a distance from the opposite control-cam section 121 as is sufficiently large for the passage of the pin 113. The control-cam section 121 has in front of it a pin-acceleration curve 122 which passes, via a snap-spring-like elevation 123, into the control-cam section 121.

Also in this development, it is provided that the spring force acting on the second hook part 114 is less than the spring force acting on the release 110.

Figure 22:
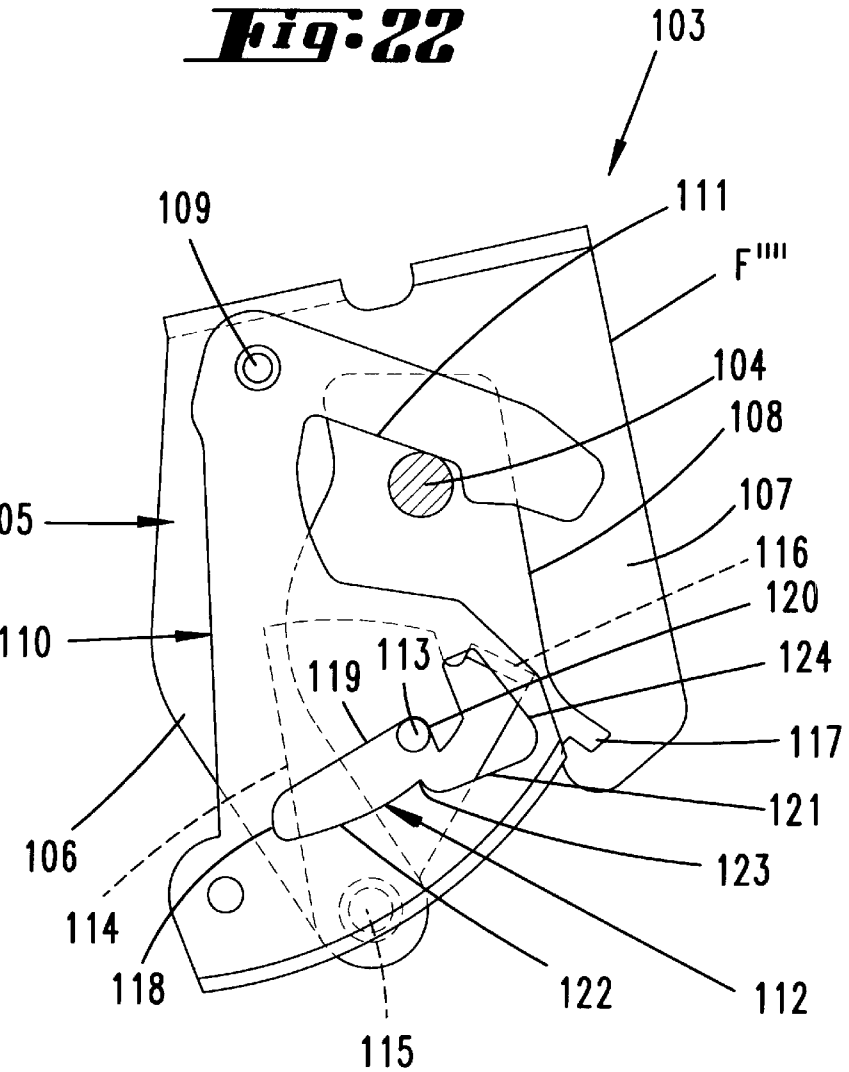
FIG. 22 shows the catch-hook arrangement in its blocking position.
Figure 21:
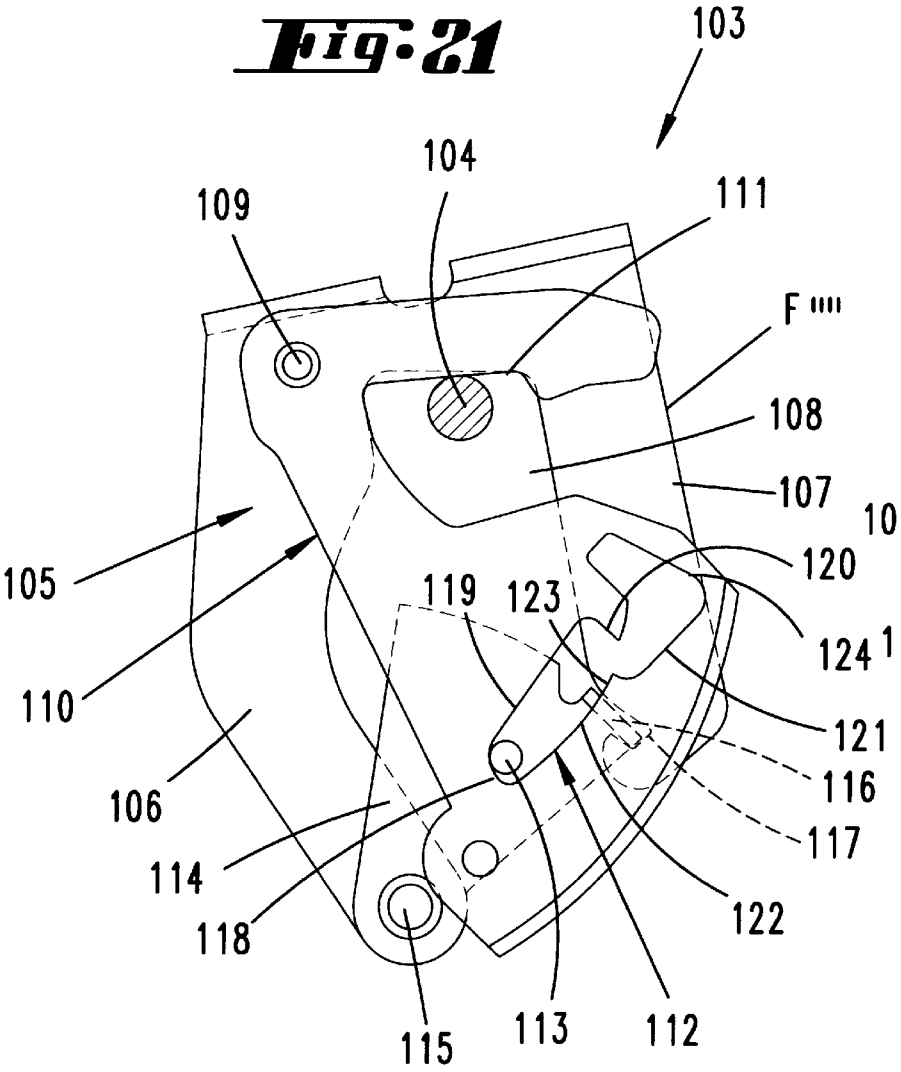
FIG. 21 is a view of the catch-hook arrangement in accordance with the fifth embodiment as to the locking position.

The following manner of operation is established:

Upon a crash, forces of inertia are active both on the second hook part 114 and on the release 110, they having the result that the pin 113 comes in front of the blocking shoulder 120 of the release 110; see FIG. 22. The closure hoop 104 can accordingly not leave the catch-hook opening 108, as a result of which the front hood is secured against springing open.

Figure 23:
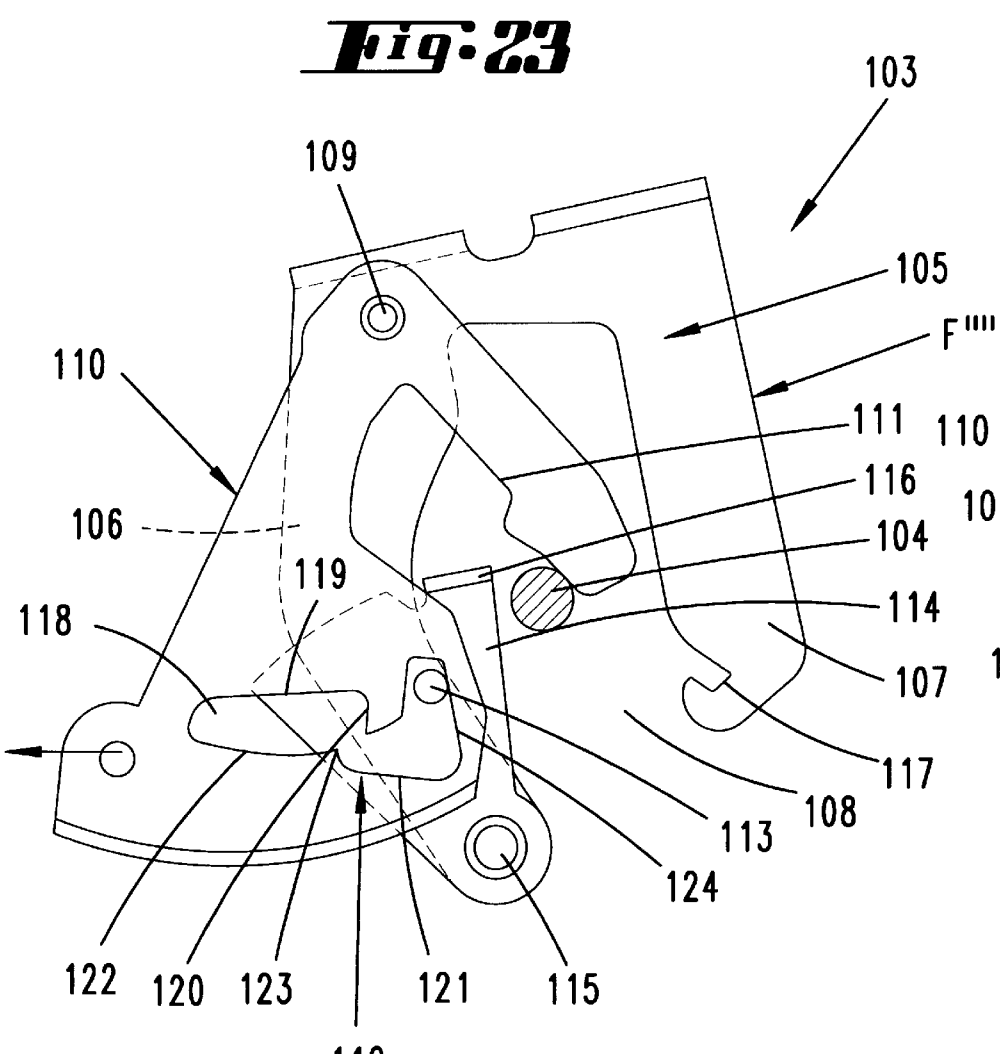
FIG. 23 shows the catch-hook arrangement in the position of release of the closure hoop caused by the release.

Upon the proper opening of the catch-hook arrangement 103, the pin 113 travels over the control cam 122 and comes against its shoulder 124, as a result of which the second hook part 114 is swung into a position releasing the catch-hook opening 108; see FIG. 23. The opening of the engine hood is thereby permitted. After the opening of the engine hood, both release 100 and second hook part 114 pass into their starting position shown in FIG. 20. These parts are then swung positively into a position of release upon the closing of the engine hood by the closure hoop 104.

Figure 24:
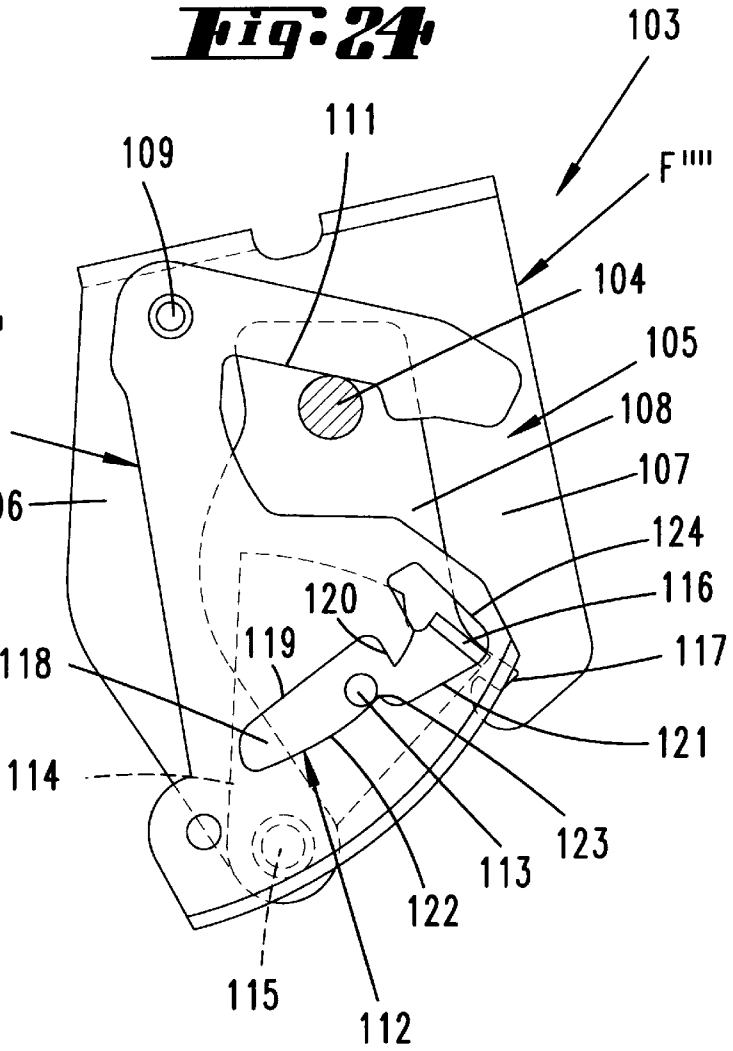
FIG. 24 shows the catch-hook arrangement in a position which results upon a strongly accelerated swinging of the release.

However, the case in accordance with FIG. 24 may also occur, it taking place in the event of a strongly accelerated swinging of the release. In this case, the pin-acceleration cam 122 acts on the pin 113, which is thereby brought onto the blocking shoulder 130 so that the second hook part 114 and the release 110 enter into a blocking position with respect to each other and thus actively close the catch-hook opening 108.

The catch-hook arrangement 125 shown in FIGS. 25 to 28 has a catch hook F"", which is carried by a journal pin 126 of a bearing pedestal shown in dash-dot line. The catch hook F"" forms a first hook part 128. This is so associated with the bearing pedestal 127 that a swinging in clockwise direction is impossible. A swinging in counterclockwise direction takes place against spring loading. The hook part 128 has two downward directed legs 129, 130, which leave a catch-hook opening 131 between them. The size of the opening is greater than the diameter of the closure hoop 132. The leg 130 is provided with a downwardly directed hook projection 133 which serves to reduce the size of the catch-hook opening 131.

The journal pin 126 furthermore supports a double-armed control level 134. The downward directed lever arm 135 thereof extends by a hook projection 135' into the catch-hook opening 131 and is tangent to the arm 129, while the other lever arm 136 terminates in a coupling pin 137. The obliquely upward pointing coupling pin 137 in the locking position shown in FIGS. 25 and 26 passes through a longitudinal slot 138 of an actuating lever 140 mounted on the bearing block 127 of the pivot pin 129. A torsion spring (not shown) associated with the pivot pin 139 urge the actuating lever 140 in counterclockwise direction. The spring-actuated rotary displacement is limited by a stop shoulder 141 of the bearing block 127. By means of its step-shaped end, the actuating lever 140 forms an attack arm 140'. On it, there acts a connecting rod (not shown) by means of which the actuating lever 140 can be swung in clockwise direction in order to open the catch-hook arrangement 125. Between the slot 138 and the attack arm 140', the actuating lever 140 forms a control cam 142.

The aforementioned control cam 142 cooperates with a closure part 143 which is developed as a double-armed lever. The latter is mounted around a pivot pin 144 of the leg 129. The one lever arm 143' extends by its free end into the catch-hook arrangement 131 and reduces the size thereof to an amount which is less than the diameter of the closure hoop 132. The other lever arm 143" lies, on the other hand, in the direction of movement of the control cam 142 of the actuating lever 140. A torsion spring (not shown) arranged on the pivot pint 140 urges the double-armed closure part 143 in clockwise direction. The swinging displacement is limited by a stop 145 present on the lower end of the leg 129.

The catch-hook arrangement in accordance with this sixth embodiment operates as follows:

With the catch-hook arrangement present in locked position (see FIGS. 25 and 26), the springing open of the engine hood may be prevented in the manner that the double-armed closure part 143 extends by its lever arm 143' into the path of movement of the blocking hoop 132.

Figure 26:
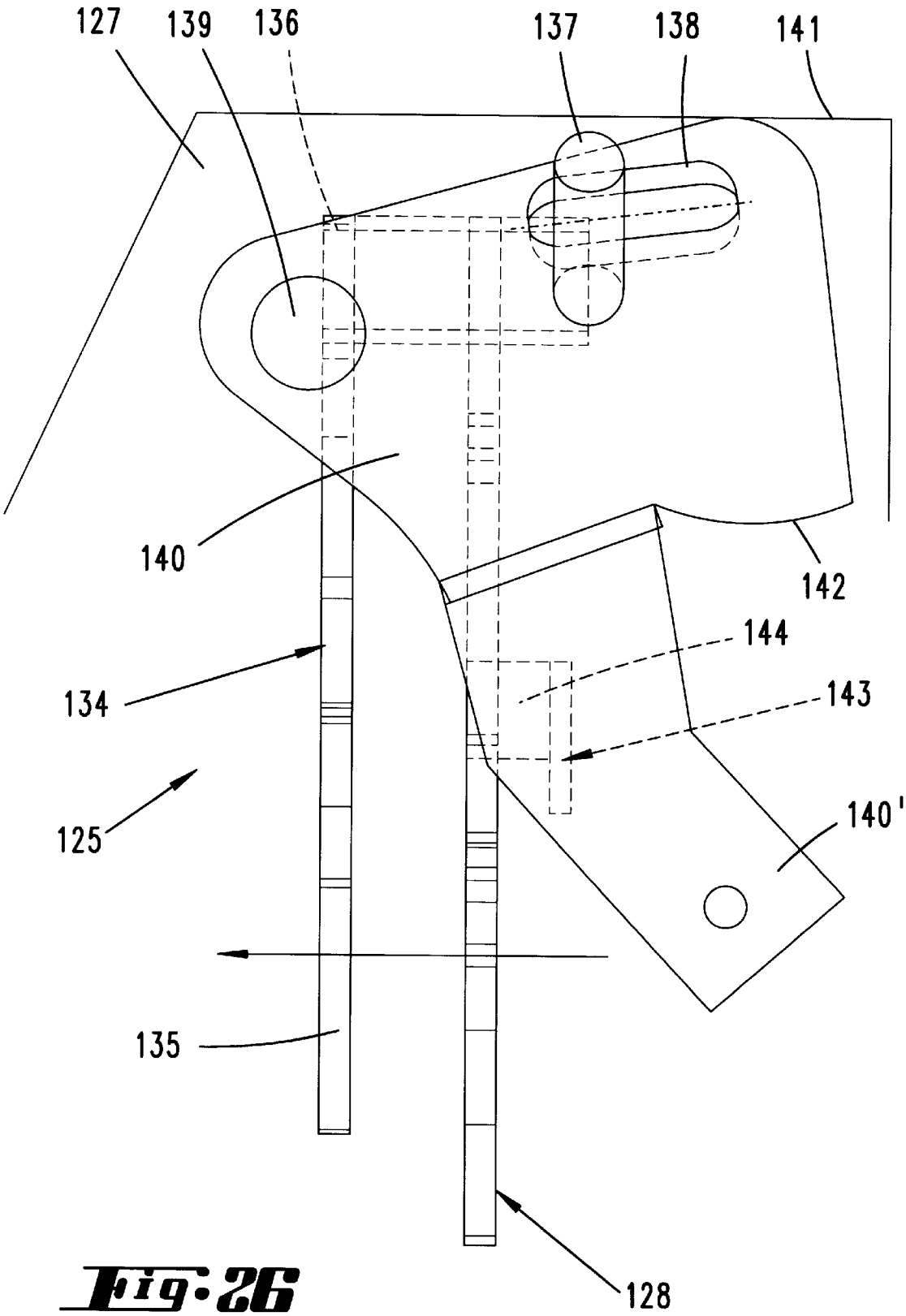
FIG. 26 shows the side view, swung 90°, of FIG. 25.
Figure 27:
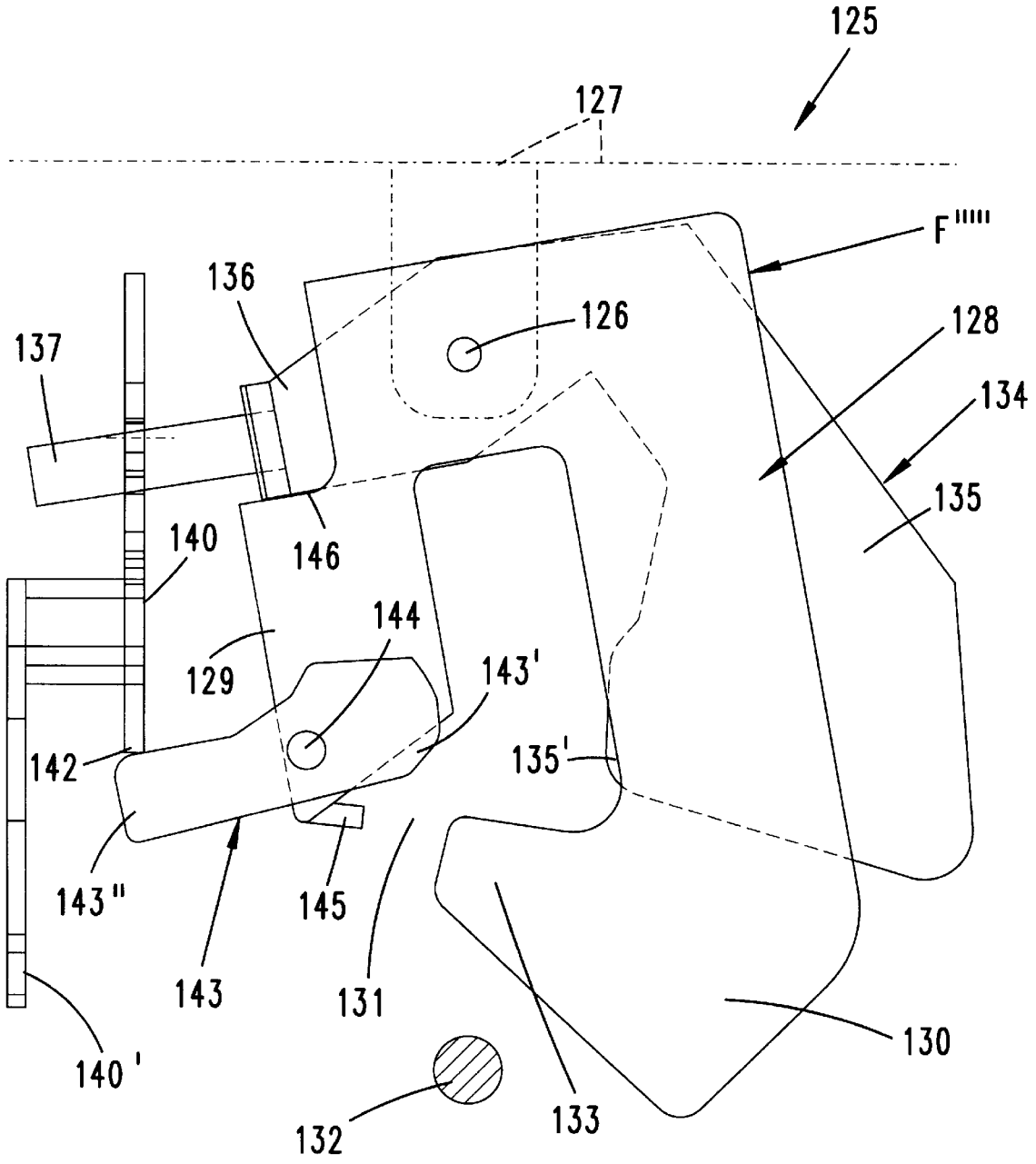
FIG. 27 shows a position corresponding to FIG. 25, but relating to the position of the release.
Figure 28:
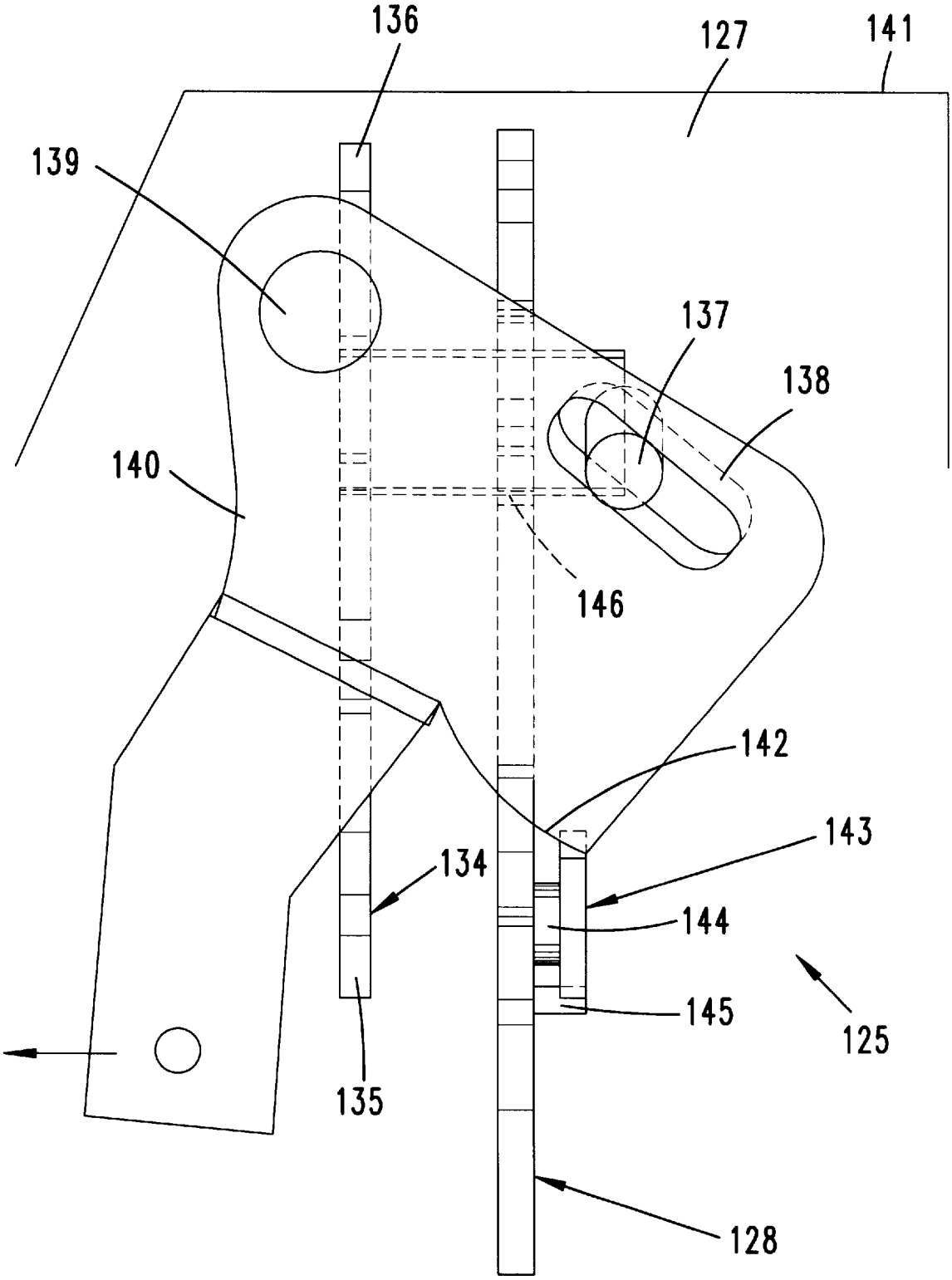
FIG. 28 is a side view of FIG. 25.

The opening of the engine hood requires, first of all, the release of a known closure (not shown). Thereupon, the actuating mechanism must be pulled in the direction of the arrow shown in FIG. 26, together with a swinging of the actuating lever 140. In this connection, the actuating lever 140 via the pin/slot engagement 137/138 carries the control lever 134 along in counterclockwise direction. After passing through a freeway, the lever arm 136 acts on a driver shoulder 146 of the hook part 128 and swings it in counterclockwise direction against spring load so that thereupon the position shown in FIGS. 27 and 28 is present. Furthermore, the control cam 142 acts on the lever arm 143" and swings the double arm closure part 143 connected therewith, so that the lever arm 143' releases the catch-hook opening 131, whereupon the closure hoop 132 can leave the catch-hook opening 131.

Figure 25:
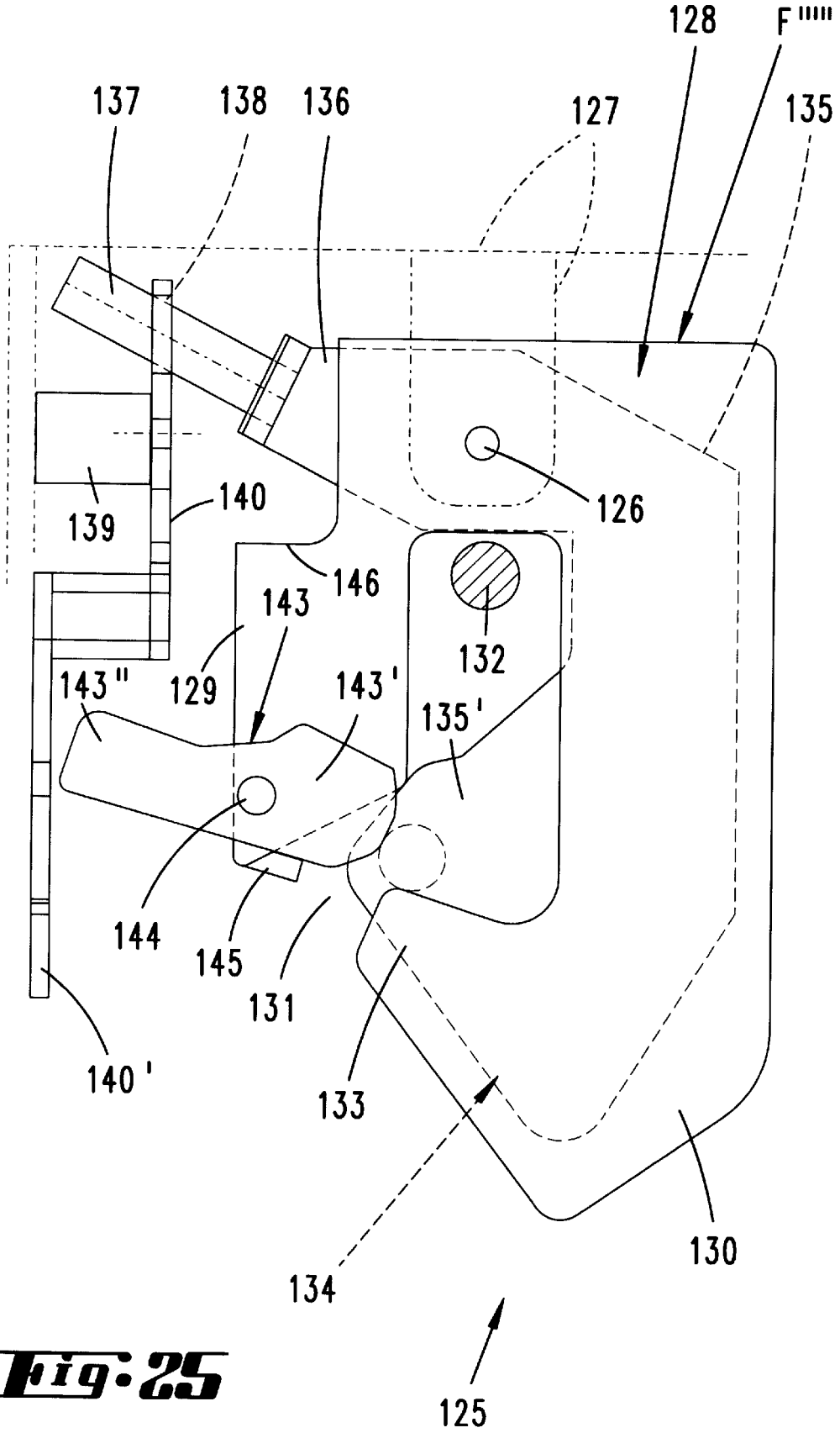
FIG. 25 is a view of the catch-hook arrangement in the case of the sixth embodiment with respect to the closure position.

After the opening of the engine hood, the parts of the catch-hook arrangement 125 return into their starting position shown in FIG. 25. Upon the closing of the engine hood, the closure hoop 132 strikes, one after the other, the hook part 128, the control lever 134, and the double-armed closure part 143, and comes into the catch-hook opening 131 so that, then again, the starting position shown in FIGS. 25 and 26 is present.

I claim:

1. A catch-hook arrangement operable with a front hood on a motor vehicle, comprising:

a closure hoop and a catch hook which, upon being attached to the vehicle, are fastenable alternatively to the front end of the body of the vehicle or to the front hood of the vehicle;

upon being attached to the vehicle, the hoop and the hook provide a closure by mutual engagement of the hoop and the hook, which closure is operative to hold the front hood in a slit-open position after an opening of the closure, the closure being detachable and being obtainable automatically upon a closing of the hood;

wherein the catch hook has two legs and a first hook part located between an end section of each of its two legs;

the catch hook has a second hook part which is pivoted on an end section of one of said two legs and is developed as a closure part and serves to close an opening of the first hook part under spring force; and the structure of the first hook part between the end sections of the two legs provides for passage of the hoop on the one leg end section upon which is pivoted the second hook part.

2. A catch-hook arrangement according to claim 1, wherein the first hook part is formed in U-shape.

3. A catch-hook arrangement operable with a front hood on a motor vehicle, comprising:

a closure hoop and a catch hook which, upon being attached to the vehicle, are fastenable alternatively to the front end of the body of the vehicle or to the front hood of the vehicle;

upon being attached to the vehicle, the hoop and the hook provide a closure by mutual engagement of the hoop and the hook, which closure is operative to hold the front hood in a slit-open position after an opening of the closure, the closure being detachable and being obtainable automatically upon a closing of the hood;

wherein the catch hook has two legs and a first hook part located between an end section of each of its two legs;

the catch hook has a second hook part which is pivoted on an end section of one of said two legs and is developed as a closure part and serves to close an opening of the first hook part in force-locked manner; and the structure of the first hook part between the end sections of the two legs provides for passage of the hoop on the one leg end section upon which is pivoted the second hook part;

the first hook part is formed in U-shape; and the second hook part is swingable under switch load, into a U-space of the U-shape of the first hook part in a form-locked engagement with the other U-leg end section.

4. A catch-hook arrangement operable with a front hood on a motor vehicle, comprising:

a closure hoop and a catch hook which, upon being attached to the vehicle, are fastenable alternatively to the front end of the body of the vehicle or to the front hood of the vehicle;

upon being attached to the vehicle, the hoop and the hook provide a closure by mutual engagement of the hoop and the hook, which closure is operative to hold the front hood in a slit-open position after an opening of the closure, the closure being detachable and being obtainable automatically upon a closing of the hood;

wherein the catch hook has two legs and a first hook part located between an end section of each of its two legs;

the catch hook has a second hook part which is pivoted on an end section of one of said two legs and is developed as a closure part and serves to close an opening of the first hook part in force-locked manner; and the structure of the first hook part between the end sections of the two legs provides for passage of the hoop on the one leg end section upon which is pivoted the second hook part; and wherein the catch-hook arrangement further comprises a support shoulder (30) developed by the second hook part and urged by the closure hoop (4) in the slit-open position.

5. A catch-hook arrangement according to claim 3, wherein the form-locked engagement is developed by a hooking in such a manner that a projection (17, 46) extending away from the U-opening (7, 41) enters into a recess (18, 47) in the second hook part (15, 45).

6. A catch-hook arrangement operable with a front hood on a motor vehicle, comprising:

a closure hoop and a catch hook which, upon being attached to the vehicle, are fastenable alternatively to the front end of the body of the vehicle or to the front hood of the vehicle;

upon being attached to the vehicle, the hoop and the hook provide a closure by mutual engagement of the hoop and the hook, which closure is operative to hold the front hood in a slit-open position after an opening of the closure, the closure being detachable and being obtainable automatically upon a closing of the hood;

wherein the catch hook has two legs and a first hook part located between an end section of each of its two legs;

the catch hook has a second hook part which is pivoted on an end section of one of said two legs and is developed as a closure part and serves to close an opening of the first hook part in force-locked manner; and the structure of the first hook part between the end sections of the two legs provides for passage of the hoop on the one leg end section upon which is pivoted the second hook part; and wherein in a region of a U-vertex the first hook part has an attachment means (10) in particular for swingable fixing around a spring-actuated central position.

7. A catch-hook arrangement operable with a front hood on a motor vehicle, comprising:

a closure hoop and a catch hook which, upon being attached to the vehicle, are fastenable alternatively to the front end of the body of the vehicle or to the front hood of the vehicle;

upon being attached to the vehicle, the hoop and the hook provide a closure by mutual engagement of the hoop and the hook, which closure is operative to hold the front hood in a slit-open position after an opening of the closure, the closure being detachable and being obtainable automatically upon a closing of the hood;

wherein the catch hook has two legs and a first hook part located between an end section of each of its two legs;

the catch hook has a second hook part which is pivoted on an end section of one of said two legs and is developed as a closure part and serves to close an opening of the first hook part in force-locked manner; and the structure of the first hook part between the end sections of the two legs provides for passage of the hoop on the one leg end section upon which is pivoted the second hook part; and wherein the catch-hook arrangement further comprises a release which is pivoted to the first hook part.

8. A catch-hook arrangement according to claim 7, wherein the release displaces the second hook part by swinging into a position of release.

9. A catch-hook arrangement according to claim 7, wherein the release (21, 89, 110) is coupled with the second hook part (15, 96, 114) via a pin/cam control (22, 23; 95, 100; 112, 113).

10. A catch-hook arrangement according to claim 7, wherein the release (21) is developed as a bell-crank lever having a hook extension (24) extending into the region of motion of the closure hoop (4), said hook extension is acted on upon the closing and the swinging of the release (21) with displacement of the second hook part (15) into form-locked engagement.

11. A catch-hook arrangement operable with a front hood on a motor vehicle, comprising:

a closure hoop and a catch hook which, upon being attached to the vehicle, are fastenable alternatively to the front end of the body of the vehicle or to the front hood of the vehicle;

upon being attached to the vehicle, the hoop and the hook provide a closure by mutual engagement of the hoop and the hook, which closure is operative to hold the front hood in a slit-open position after an opening of the closure, the closure being detachable and being obtainable automatically upon a closing of the hood;

wherein the catch hook has two legs and a first hook part located between an end section of each of its two legs;

the catch hook has a second hook part which is pivoted on an end section of one of said two legs and is developed as a closure part and serves to close an opening of the first hook part in force-locked manner; and the structure of the first hook part between the end sections of the two legs provides for passage of the hoop on the one leg end section upon which is pivoted the second hook part; and wherein the catch-hook arrangement further comprises a release disposed on a leg end and having a point of attack (26) for a handle (27).

12. A catch-hook arrangement operable with a front hood on a motor vehicle, comprising:

a closure hoop and a catch hook which, upon being attached to the vehicle, are fastenable alternatively to the front end of the body of the vehicle or to the front hood of the vehicle;

upon being attached to the vehicle, the hoop and the hook provide a closure by mutual engagement of the hoop and the hook, which closure is operative to hold the front hood in a slit-open position after an opening of the closure, the closure being detachable and being obtainable automatically upon a closing of the hood;

wherein the catch hook has two legs and a first hook part located between an end section of each of its two legs;

the catch hook has a second hook part which is pivoted on an end section of one of said two legs and is developed as a closure part and serves to close an opening of the first hook part in force-locked manner; and the structure of the first hook part between the end sections of the two legs provides for passage of the hoop on the one leg end section upon which is pivoted the second hook part; and wherein a closure-hoop arm (6) and the second hook part (15) in the slit-open position of the front hood (1) are at a distance apart which permits a swinging of the second hook part (15) into the position of release with respect to the closure hoop (4).

13. A catch-hook arrangement operable with a front hood on a motor vehicle, comprising:

a closure hoop and a catch hook which, upon being attached to the vehicle, are fastenable alternatively to the front end of the body of the vehicle or to the front hood of the vehicle;

upon being attached to the vehicle, the hoop and the hook provide a closure by mutual engagement of the hoop and the hook, which closure is operative to hold the front hood in a slit-open position after an opening of the closure, the closure being detachable and being obtainable automatically upon a closing of the hood;

wherein the catch hook has two legs and a first hook part located between an end section of each of its two legs;

the catch hook has a second hook part which is pivoted on an end section of one of said two legs and is developed as a closure part and serves to close an opening of the first hook part in force-locked manner; and the structure of the first hook part between the end sections of the two legs provides for passage of the hoop on the one leg end section upon which is pivoted the second hook part; and wherein the second hook part has an opening-outwardly-directed control bevel (29).

14. A catch-hook arrangement operable with a front hood on a motor vehicle, comprising:

a closure hoop and a catch hook which, upon being attached to the vehicle, are fastenable alternatively to the front end of the body of the vehicle or to the front hood of the vehicle;

upon being attached to the vehicle, the hoop and the hook provide a closure by mutual engagement of the hoop and the hook, which closure is operative to hold the front hood in a slit-open position after an opening of the closure, the closure being detachable and being obtainable automatically upon a closing of the hood;

wherein the catch hook has two legs and a first hook part located between an end section of each of its two legs;

the catch hook has a second hook part which is pivoted on an end section of one of said two legs and is developed as a closure part and serves to close an opening of the first hook part in force-locked manner; and the structure of the first hook part between the end sections of the two legs provides for passage of the hoop on the one leg end section upon which is pivoted the second hook part; and wherein the second hook part has an opening-inwardly-directed carrier shoulder (30) which extends parallel to the opening.

15. A catch-hook arrangement according to claim 2, wherein the U-shaped hook part (38) is developed by a carrier plate (39) which carries the closure (37) which cooperates with the closure hoop (33).

16. A catch-hook arrangement according to claim 15, further comprising a control lever (50) pivoted in particular to the leg (43), formed as a U-leg, for transferring the closure part (hook part 38) in the direction of a form-locked engagement upon entrance of the closure hoop (33) into the closure (37).

17. A catch-hook arrangement according to claim 16, wherein the control lever (50) is double-armed and can be acted on its first lever arm (50') by the closure hoop (33) and acts by its second lever arm (50") against a drive (49) of the closure part (hook part 45).

18. A catch-hook arrangement according to claim 17, wherein the closure part (hook part 45) forms a handle (48).

19. A catch-hook arrangement according to claim 15, wherein the closure (37) is a rotary-trap closure.

20. A catch-hook arrangement according to claim 1, wherein the closure part (second hook part 71) is pivoted to a hook-shaped extension (69) of the first hook part (65).

21. A catch-hook arrangement according to claim 20, wherein a carrier shoulder is formed by a release (76).

22. A catch-hook arrangement according to claim 21, wherein the extension (69) moves out of the path of movement of the closure hoop (60) by a pulling action on the release (76).

23. A catch-hook arrangement according to claim 22, wherein the closure hoop (60) upon its displacement from the closed position of the front hood into the slit-open position can be swung by action thereon of an edge (79') of the release (76) such that a handle can be actuated.

24. A catch-hook arrangement according to claim 1, wherein the second hook part (96, 114) and release (89, 110) are coupled with each other in such a manner that forces of inertia acting on them lead to a self-blocking of the second hook part (96, 114) an d the release (89, 110) holding the catch-hook arrangement (82, 103) in a closed position.

25. A catch-hook arrangement according to claim 24, further comprising a mounting or dimensioning of return springs (90, 98) of the second hook part (96) and the release (89) such that the second hook part (96) leads the release (89) upon the jolt-like impact of the force of inertia.

26. A catch-hook arrangement according to claim 1, further comprising a blocking shoulder (101, 120) formed by a cam control (94, 112) of a pin/cam control, against which shoulder a pin (95, 113) acts upon sudden impact of force of inertia.

27. A catch-hook arrangement according to claim 1, wherein self-blocking occurs by a strongly accelerated release swinging.

28. A catch-hook arrangement according to claim 1, further comprising a pin-acceleration cam (122) which is arranged in front of a blocking shoulder (120) and which is arranged opposite a cam-control section (119) having the blocking shoulder (120).

29. A catch-hook arrangement according to claim 1, wherein the closure part (143) is developed as a double-armed lever, one lever arm (143') of which closes hook opening (131) against emergence of the closure hoop (132) and another arm (143") of which is acted upon upon an opening actuation.

30. A catch-hook arrangement according to claim 29, wherein the actuation occurs by a control cam (142) of an actuating lever (140).

31. A catch-hook arrangement according to claim 30, wherein the actuating lever (140) swings transverse to the direction of swing of the closure part (143).

* * * * *